US006217157B1

(12) United States Patent
Yoshihira et al.

(10) Patent No.: US 6,217,157 B1
(45) Date of Patent: Apr. 17, 2001

(54) LIQUID DISCHARGING HEAD AND LIQUID DISCHARGING APPARATUS

(75) Inventors: Aya Yoshihira, Yokohama; Toshio Kashino, Chigasaki; Kiyomitsu Kudo, Kawasaki; Satoshi Shimazu, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/333,003

(22) Filed: Jun. 15, 1999

(30) Foreign Application Priority Data

| | | |
|---|---|---|
| Jun. 22, 1998 | (JP) | 10-174771 |
| Jun. 22, 1998 | (JP) | 10-174772 |
| Jun. 22, 1998 | (JP) | 10-174773 |
| Jun. 22, 1998 | (JP) | 10-174774 |
| Jun. 22, 1998 | (JP) | 10-174775 |
| Sep. 10, 1998 | (JP) | 10-256964 |

(51) Int. Cl.[7] ..... B41J 2/05; B41J 2/17
(52) U.S. Cl. ..... 347/65; 347/94
(58) Field of Search ..... 347/54, 63, 65, 347/94

(56) References Cited

U.S. PATENT DOCUMENTS

| | | | | |
|---|---|---|---|---|
| 4,723,129 | | 2/1988 | Endo et al. | 347/56 |
| 5,943,074 | * | 8/1999 | Kashino et al. | 347/54 |

FOREIGN PATENT DOCUMENTS

| | | | | |
|---|---|---|---|---|
| 0 811 492 | | 12/1997 | (EP) | B41J/2/05 |
| 0 819 541 | | 1/1998 | (EP) | B41J/2/165 |
| 0 841 166 | | 5/1998 | (EP) | B41J/2/14 |
| 55-81172 | | 6/1980 | (JP) . | |
| 59-26270 | | 2/1984 | (JP) . | |
| 61-59911 | | 3/1986 | (JP) . | |
| 61-59914 | | 3/1986 | (JP) . | |
| 4-329148 | | 11/1992 | (JP) . | |
| 405084913 | * | 4/1993 | (JP) | 347/65 |
| 5-229122 | | 9/1993 | (JP) . | |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

For stabilizing the liquid discharge from the head such as in the ink jet recording the invention provides a liquid discharging head comprising a discharge liquid path communicating with a discharge opening for discharging a discharge liquid and adapted to flow the discharge liquid, a bubble generating liquid path including a bubble generating area for bubble generation and adapted to flow a bubble generating liquid and a movable separating membrane adapted for mutually and substantially separating the discharge liquid path and the bubble generating liquid path and having a recess, in a position corresponding to the bubble generating area, deviated so as to narrow the bubble generating liquid path, wherein the recess has substantially non-displacing corner portions and is adapted to displace, excluding the corner portions, by a bubble generated in the bubble generating area.

26 Claims, 29 Drawing Sheets

LIQUID DISCHARGING HEAD AND LIQUID DISCHARGING APPARATUS

BACKGROUND OF THE INVENTION

1. Field of the Invention

The present invention relates to a liquid discharging head and a liquid discharging apparatus for discharging liquid by bubble generation for example by thermal energy, and more particularly to a liquid discharging head and a liquid discharging apparatus utilizing a movable separation membrane which is moved by the bubble.

The present invention is applicable to a printer for recording on various recording media such as paper, yarn, fiber, fabrics, leather, metal, plastics, glass, timber, ceramics etc., a copying machine, a facsimile apparatus having a communication system, a work processor having a printer unit, and an industrial recording apparatus combined in composite manner with various processing apparatus. In the present invention, the "recording" means not only forming a meaningful image such as a character or graphics on the recording medium but also forming a meaningless image such as a pattern.

2. Related Background Art

There is already known an ink jet recording method, so-called bubble jet recording method, for providing liquid such as ink with an energy such as heat to generate a state change involving a steep volume change (generation of a bubble), causing the liquid to be discharged through a discharge opening by the force based on such state change and depositing the liquid onto the recording medium to form an image. The recording head utilizing such bubble jet recording method is generally provided, as disclosed in the Japanese Patent Publication Nos. 61-59911 and 61-59914 (corresponding to the U.S. Pat. No. 4,723,129), with a discharge opening for discharging liquid, a liquid path communicating with the discharge opening, and a heat generating member (electrothermal converting member) positioned corresponding to the liquid path and serving as energy generating means for generating energy for discharging the liquid.

Such recording method is advantageous in various manners such as being capable of printing an image of high quality at a high speed and a low noise level, printing an image of a high resolution with a compact apparatus since the discharge openings can be arranged with a high density, and obtaining a color image in a simple manner. For this reason, the bubble jet recording method is recently utilized in various office equipment such as printer, copying machine, facsimile etc. and even in certain industrial applications such as fabric printing apparatus.

On the other hand, in the conventional bubble jet recording method, as the heat generating member repeats heating in direct or indirect contact with liquid, there may be formed, on the surface of the heat generating member, a deposit resulting from scorching of the liquid. Also, in case the liquid to be discharged is easily deteriorated by heat or cannot show sufficient bubble generation, satisfactory liquid discharge may not be achieved by the bubble formation by the aforementioned heat generating member.

On the other hand, the Japanese Patent Application Laid-Open No. 55-81172 proposed a method of separating a bubble generating liquid and a discharge liquid by a flexible membrane and generating a bubble in the bubble generating liquid by thermal energy thereby discharging the discharge liquid. In the configuration of the proposed method, the flexible membrane and the bubble generating liquid are so positioned that the flexible membrane is provided in a part of the nozzle, but the Japanese Patent Application Laid-Open No. 59-26270 discloses a configuration employing a large membrane separating the entire head into an upper part and a lower part. Such large membrane, being supported between two plate members constituting the liquid path, is so provided that the liquids in the two liquid paths are not mutually mixed. Also there are known configurations giving certain feature to the bubble generating liquid itself in consideration of the bubble generating characteristics, such as the one disclosed in the Japanese Patent Application Laid-Open No. 5-229122, employing liquid of a lower boiling point than that of the discharge liquid or the one disclosed in the Japanese Patent Application Laid-Open No. 4-329148, employing electrically conductive liquid as the bubble generating liquid.

SUMMARY OF THE INVENTION

The present inventors have found a novel issue, not known in the prior art, with respect to the displacement range of the movable separating membrane. The separating membrane in the liquid discharging head of the present invention is supported between a first liquid path wall and a second liquid path wall, and the movable area for each liquid path is limited by the liquid path walls. It is thus confirmed that the first and second liquid path walls define the displacement of the membrane and have significant influence on the characteristics of the head. Therefore the present inventors have concluded that it is important to define the displacement of the membrane by the membrane itself instead of the liquid path wall to achieve smooth membrane displacement thereby maintaining the highly reliable liquid discharging characteristics.

Therefore, the present inventors have made intensive investigation in order to provide a liquid discharging head excellent in durability and stability of liquid discharging regardless of the kind of the supplied liquid, while exploiting the effect of the separating function of the separating membrane. As a result, the present inventors have tried a membrane substantially free from elongation and having a recessed portion, and found that the amount of displacement of the recessed portion corresponds to the discharge amount of the liquid. Thus, it has been found that the stable discharge can be achieved regardless of the kind of the supplied liquid by defining the displacement amount of the recessed portion, as the discharge amount corresponds to the displacement amount of the recessed portion of the separating membrane. It has also been found that the durability of the separating membrane can be improved by defining the displacement amount of the recessed portion of the separating membrane in such a manner that such recessed portion does not elongate or contract at the maximum displacement. It has furthermore been found that the refiling of the discharge liquid can be improved by utilizing the self returning force of the membrane when the recessed portion is not given energy for the displacement.

From a different standpoint, in case various liquids are used as the discharge liquid, the amount of liquid discharged from the discharge opening for example by thermal energy fluctuates depending on the kind of the liquid. Such fluctuation tends to increase with the increase in the vicsocity of the liquid. However, a method of stabilizing the discharge amount in a given liquid discharging head, by varying the discharge energy according to the kind of the supplied liquid, is complex and is difficult to practice. Consequently it is important to provide a recording head capable, with a simple structure, of realizing stable liquid discharge regardless of the kind of the supplied liquid.

An object of the present invention, attained by such intensive investigation, is to provide a novel liquid discharging head and a novel liquid discharging apparatus, capable of improving the efficiency of liquid droplet discharge, excellent in the stability and durability of discharge and stabilizing and increasing the discharged droplet volume or discharge speed.

Another object of the present invention is to improve the discharge efficiency, discharge stability and durability in the liquid discharging head provided with a first liquid path for the discharge liquid communicating with a discharge opening, a second liquid path containing the bubble generating liquid in a suppiable or movable manner and including a bubble generating area, and a movable separating membrane for separating the first and second liquid paths, having a displacement area of the movable separating membrane at the upstream side with respect to the discharge opening.

Still another object of the present invention is to provide a liquid discharging head in which the discharge liquid and the bubble generating liquid are separated by a movable membrane, wherein the displacement of the movable separating membrane is stabilized at the pressure transmission to the discharge liquid by a displacement of the movable membrane by the pressure of bubble generation, thereby achieving excellent discharge efficiency, discharge stability and refilling efficiency.

Still another object of the present invention is to provide a liquid discharging head of the above-mentioned configuration, excellent in durability.

Still another object of the present invention is to provide a liquid discharging head of the above-mentioned configuration, capable of reducing the amount of deposit formed on the heat generating member and efficiently discharging the liquid without thermal influence thereto.

Still another object of the present invention is to provide a liquid discharging head having a wider freedom in selecting the discharge liquid, regardless of the viscosity, constituent material or composition thereof.

Still another object of the present invention is to provide a liquid discharging head in which the recessed portion of the movable separating membrane is made more easily deformable, thereby enabling to achieve a high density of the liquid path walls.

Still another object of the present invention is to provide a liquid discharging head comprising:

a discharge liquid path communicating with a discharge opening for discharging a discharge liquid and adapted to flow the discharge liquid;

a bubble generating liquid path including a bubble generating area for bubble generation and adapted to flow a bubble generating liquid; and a movable separating membrane adapted for mutually and substantially separating the discharge liquid path and the bubble generating liquid path and having a recess, in a position corresponding to the bubble generating area, deviated so as to narrow the bubble generating liquid path;

wherein the recess has substantially non-displacing corner portions and is adapted to displace, excluding the corner portions, by a bubble generated in the bubble generating area.

Still another object of the present invention is to provide a liquid discharging head comprising:

a discharge liquid path communicating with a discharge opening for discharging a discharge liquid and adapted to flow the discharge liquid;

a bubble generating liquid path including a bubble generating area for bubble generation and adapted to flow a bubble generating liquid; and a movable separating membrane adapted for mutually and substantially separating the discharge liquid path and the bubble generating liquid path and having a recess, in a position corresponding to the bubble generating area, deviated so as to narrow the bubble generating liquid path;

wherein the volume V1 of the recess in a still state and the volume V2 of the recess at the maximum displacement satisfy a relation:

$$V2<V1.$$

Still another object of the present invention is to provide a liquid discharging apparatus comprising:

a liquid discharging head including a discharge liquid path communicating with a discharge opening for discharging a discharge liquid and adapted to flow the discharge liquid; a bubble generating liquid path including a bubble generating area for bubble generation and adapted to flow a bubble generating liquid; and a movable separating membrane adapted for mutually and substantially separating the discharge liquid path and the bubble generating liquid path and having a recess, in a position corresponding to the bubble generating area, deviated so as to narrow the bubble generating liquid path; wherein the recess has substantially non-displacing corner portions and is adapted to displace, excluding the corner portions, by a bubble generating in the bubble generating area; and transport means for transporting a recording medium for forming a record by receiving the discharge liquid discharge from the liquid discharging head.

Still another object of the present invention is to provide a liquid discharging apparatus comprising:

a liquid discharging head including a discharge liquid path communicating with a discharge opening for discharging a discharge liquid and adapted to flow the discharge liquid; a bubble generating liquid path including a bubble generating area for bubble generation and adapted to flow a bubble generating liquid; and a movable separating membrane adapted for mutually and substantially separating the discharge liquid path and the bubble generating liquid path and having a recess, in a position corresponding to the bubble generating area, deviated so as to narrow the bubble generating liquid path; wherein the volume V1 of the recess in a still state and the volume V2 of the recess at the maximum displacement satisfy a relation V2<V1; and transport means for transporting a recording medium for forming a record by receiving the discharge liquid discharge from the liquid discharging head.

According to the present invention, the movable separating membrane, for separating the first liquid path in which the discharge liquid is supplied and the second liquid path in which the non-discharged bubble generating liquid is supplied, is provided with a recessed portion so as to oppose to the bubble generating area and the fulcrum of the recessed portion is positioned at a non-displacing corner to constantly stabilize the initial state of the recessed portion and the shape thereof at the maximum displacement, thereby achieving stable liquid discharge.

Also by maintaining a relationship V2<V1 between the volume V1 of the recessed portion in a still state and the volume V2 thereof at the maximum displacement, the pressure by bubble generation acts only on the displacement of the recessed portion substantially without causing elongation or contraction of the movable separating membrane even at the maximum displacement, thereby realizing stable discharge and improved durability. Besides, with the contraction of the bubble, the recessed portion of the movable separating membrane promptly returns to the initial state by the self returning force provided by the non-displacing corner portion, thereby improving the refilling of the discharge liquid.

Furthermore, the recessed portion is provided with an inflection portion between a corner part and a bottom part, having a thickness smaller than that of the bottom part of the recessed portion, whereby the recessed portion is rendered more easily deformable and the pressure by bubble generation is more easily transmitted to the first liquid path at the side of the discharge opening thereof. Thus the liquid in the first liquid path can be efficiently discharged from the discharge opening by the bubble generation.

Furthermore, by providing the movable separating membrane with a part of a smaller thickness between the corner part and the bottom part of the recessed portion, the movable separating membrane can be made more easily deformable and the liquid in the first liquid path can be efficiently discharged from the discharge opening by the bubble generation. Furthermore, with such more easily deformable recessed portion, there can be provided a liquid discharging head sufficiently allowing to increase the density of the liquid paths.

Furthermore, by selecting the height h2 from the bottom part of the recessed portion to the inflection part thereof equal to or larger than the height hi from the heat generating member to the bottom part of the recessed portion, the pressure by bubble generation is transmitted to the movable separating membrane before it escapes to the upstream and downstream sides of the second liquid path. Consequently the pressure by bubble generation can be efficiently transmitted to the movable separating membrane, thus improving the discharge efficiency.

Furthermore, the pressure by bubble generation can be sufficiently and efficiently to the entire bottom part of the recessed portion by maintaining a relationship $W1 \geqq WH \geqq W2$ among the distance W1 between the corner parts of the recessed portion, the width W2 of the bottom part thereof and the width WH of the heat generating member. It is furthermore made possible to efficiently transmit the pressure by bubble generation to the entire bottom part of the recessed portion by maintaining a relationship $W1 \geqq W3 \geqq WH$ wherein W3 is the distance between the inflection parts, present between the corner part and the bottom part of the recessed portion.

Furthermore, the pressure by bubble generation can be satisfactorily and efficiently transmitted to the entire bottom part of the recessed portion by maintaining a relationship $S1 \geqq SH \geqq S2$ wherein S1 is the area defined by connecting the corners of the recessed portion and projected in a direction toward the heat generating member, S2 is the area of the bottom part of the recessed portion and SH is the area of the heat generating member. It is furthermore possible to more efficiently transmit the pressure by bubble generation to the entire bottom part of the recessed portion by maintaining a relationship $S1 \geqq S3 \geqq SH$ wherein S3 is the area formed by connecting the inflection parts, present between the corner part and the bottom part, of the recessed portion.

Furthermore, it is possible to supply the bubble generating liquid from a guide path at the generation or extinction of the bubble by adopting a configuration in which the liquid in the second liquid path flows in the guide path provided in the substrate. It is furthermore possible to obtain uniform pressure balance in the second liquid path by adjusting the cross section of the guide path, thereby enabling parallel displacement of the movable separating membrane more securely and more stably. Furthermore, a configuration having guide path which divide the entire liquid paths into plural blocks enables uniform liquid flow in the second liquid paths. Also a configuration having a bubble reservoir in a part of the second liquid path allows to eliminate bubbles from the liquid supplied through the guide path and to utilize the liquid with reduced bubble content, thereby more easily attaining desired bubble discharging characteristics.

DETAILED DESCRIPTION OF THE PREFERRED EMBODIMENTS

Figure 1A:
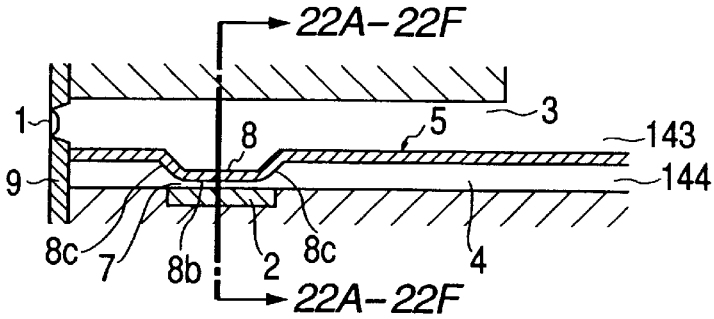
FIGS. 1A, 1B, 1C, 1D, E and 1F are cross-sectional views along the liquid path showing are embodiment of the liquid discharging head of the present invention.

Now the present invention will be clarified in detail by preferred embodiments thereof with reference to the attached drawings.

FIGS. 1A to 1F are cross-sectional views along the liquid path showing an embodiment of the liquid discharging head of the present invention, while FIGS. 2A to 2F are magnified cross-sectional views in the vicinity of the recessed portion of the movable separating membrane shown in FIGS. 1A to 1F, and FIG. 3 is a partially broken perspective view of the liquid discharging head shown in FIGS. 1A to 1F and 2A to 2F.

In the present embodiment, as shown in FIGS. 1A to 1F, a first liquid path 3 communicating with a discharge opening 1 is filled with first liquid supplied from a first common liquid chamber 143, while a second liquid path 4 containing a bubble generating area 7 is filled with bubble generating liquid which generates a bubble upon receiving thermal energy by a heat generating member 2. Between the first liquid path 3 and the second liquid path 4 there is provided a movable separating membrane 5 for mutually separating the first and second liquid paths. The movable separating membrane 5 is provided, in a portion thereof opposed to the bubble generating area 7, with a recessed portion 8 having corner parts 8*a* at the fulcrums thereof, thus forming an expansion in the first liquid path 3. The movable separating membrane 5 is fixed to an orifice plate 9 to prevent mixing of two liquids. In the second liquid path 4, the bubble generating area 7 is constituted by the vicinity of the projected area of the heat generating member 2.

Figure 3:
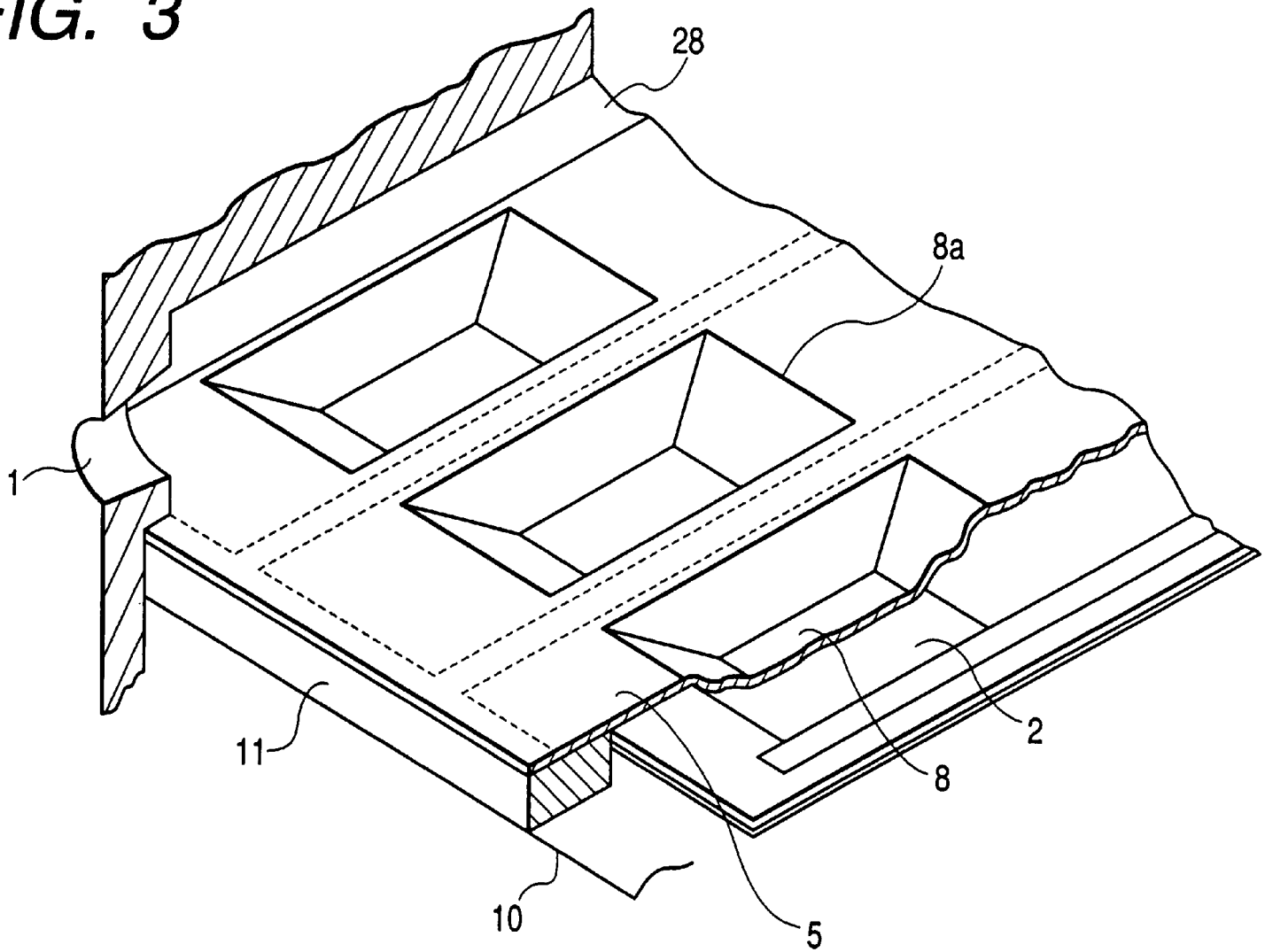
FIG. 3 is a partially broken perspective view of the liquid discharging head shown in FIGS. 1A to 1F and 2A to 2F.

As shown in FIG. 3, the heat generating member 2 is provided in an array of plural units on an element board 10, on which plural second liquid paths 4 are provided respectively corresponding to the heat generating members 2. A support member 11 supporting the movable separating membrane 5 serves also as a wall for defining and forming the second liquid paths 4. The movable separating membrane 5 is provided with plural recessed portions 8, respectively corresponding to the bubble generating areas 7 positioned in the vicinity of the bubble generating areas 7 which are in the vicinity of the projected areas of the heat generating members 2. The first liquid path 3 is provided in plural units, so as to respectively contain the recessed portions 8. In FIG. 3, however, the positions of walls 28 for defining the first liquid paths are represented by broken lines.

The present invention is based on the movement of the movable separating membrane 5, and the movable separating membrane 5 itself is provided with the recessed portion 8 which is displaced toward the first liquid path 3 by the growth of a bubble generated on the surface of the heat generating member 2.

Figure 2A:
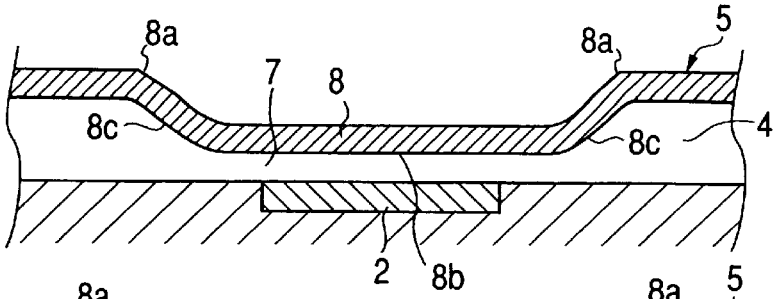
FIGS. 2A, 2B, 2C, 2D, 2E and 2F are magnified cross-sectional views in the vicinity of the recessed portion of the movable separating membrane shown in FIGS. 1A to 1F.

In an initial state shown in FIGS. 1A and 2A, the liquid in the first liquid path 3 is retracted to the vicinity of the discharge opening 1 by the capillary force. In the present embodiment, the discharge opening 1 is provided at the downstream position, in the liquid flow direction in the first liquid path 3, with respect to the projected area of the heat generating member 2 onto the first liquid path 3.

Figure 1B:
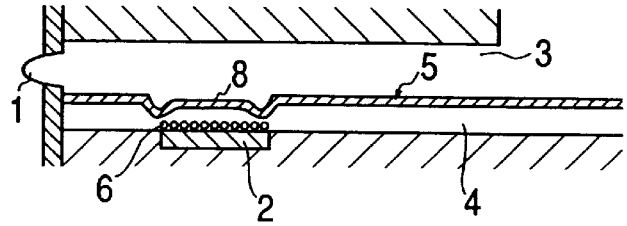
Figure 2B:
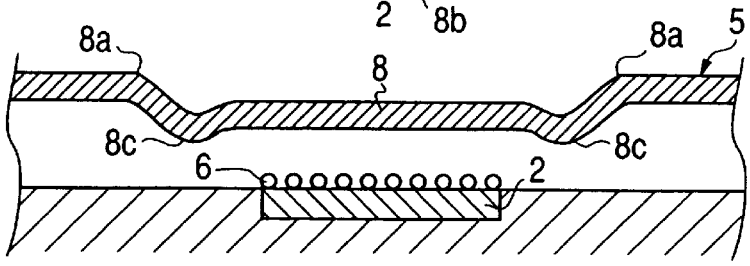

When thermal energy is given to the heat generating member 2 (consisting of a heat-generating resistance member of 40×105 μm in the present embodiment) in this state, the heat generating member 2 is rapidly heated whereby the surface thereof in contact with the second liquid in the bubble generating area heats the liquid and generates a bubble therein (FIGS. 1B and 2B). A bubble 6 thus formed is based on a film boiling phenomenon as described in the U.S. Pat. No. 4,723,129 and is generated with an extremely high pressure over the entire area of the heat generating member. The generated pressure is transmitted as a pressure wave in the second liquid in the second liquid path 4 and acts on the movable separating membrane 5, whereby the recessed portion 8 thereof is deformed to initiate the discharge of the first liquid in the first liquid path 3. However the corner parts 8*a* formed at the fulcrums of the recessed portion 8 are not involved in such deformation.

Figure 1C:
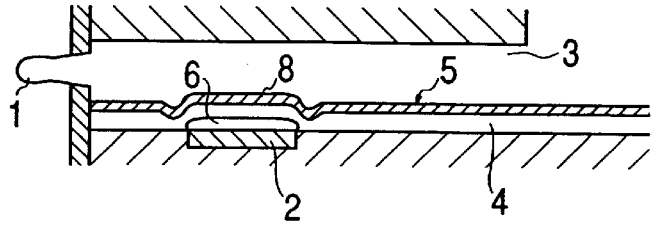
Figure 2C:
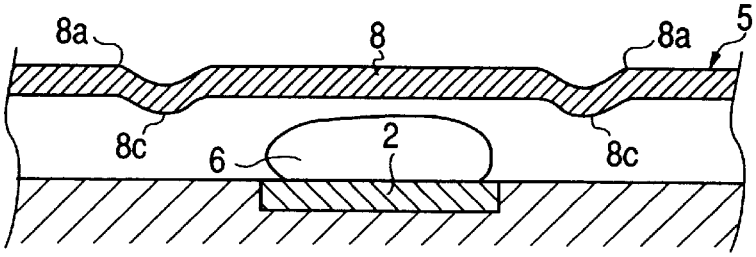

The bubble generated on the entire surface of the heat generating member 2 rapidly grows to assume a film shape (FIGS. 1C and 2C). The expansion of the bubble 6 with an extremely high pressure in the initial stage of generation causes a further deformation of the recessed portion 8 of the movable separating membrane 5, whereby the first liquid in the first liquid path 3 is further discharged from the discharge opening 1.

Figure 1D:
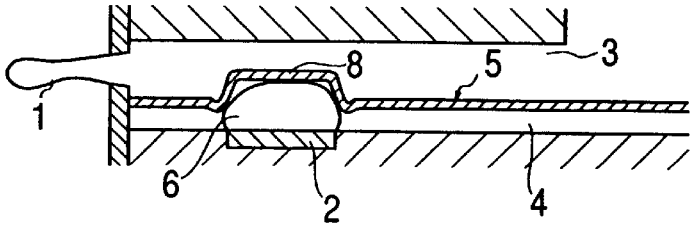
Figure 2D:
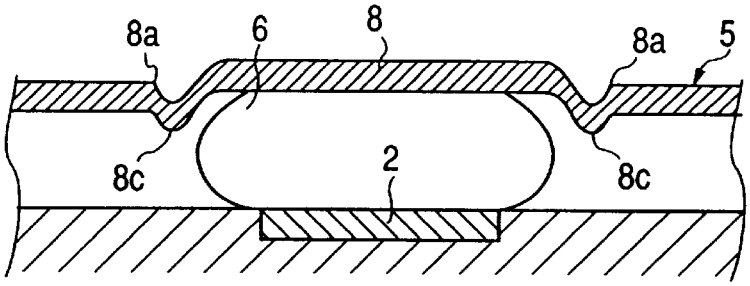

With the further growth of the bubble 6 thereafter, the deformation proceeds to such a level that the central part of the recessed portion 8, excluding the corner parts 8*a* of the membrane 5, enters the first liquid path 3 (FIGS. 1D and 2D).

Figure 1E:
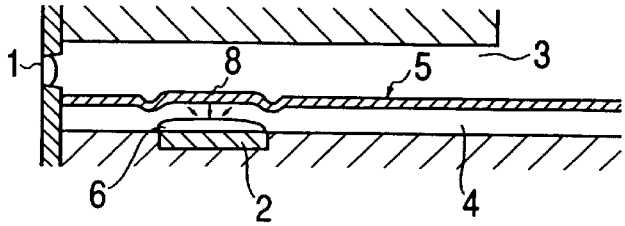
Figure 2E:
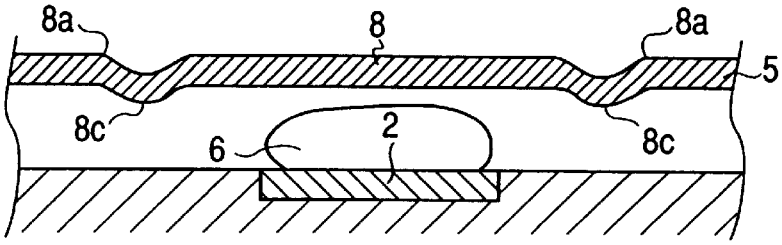

When the bubble 6 starts to contract thereafter, the recessed portion 8 of the movable separating membrane 5 starts to return to the position before deformation (FIGS. 1E and 2E).

Figure 1F:
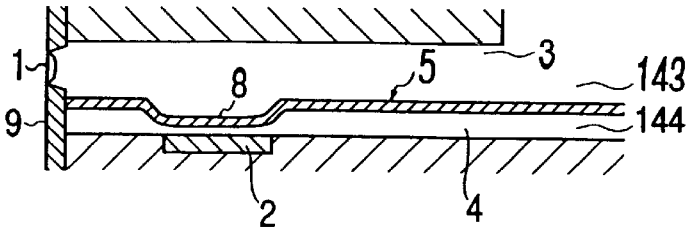
Figure 2F:
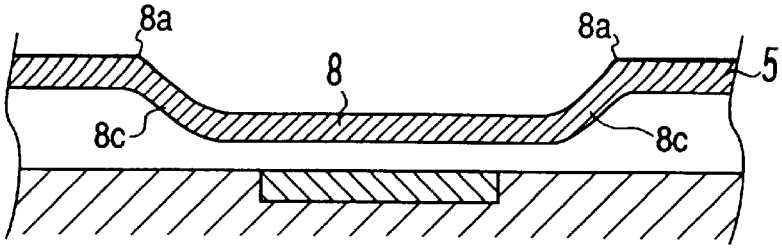

Subsequently, the recessed portion 8 of the movable separating membrane 5 promptly returns to the initial state shown in FIGS. 1F and 2F by the self returning force exerted by the non-deformed corner parts 8*a,* whereby the liquid refilling in the first liquid path 3 is accelerated. Also, with the extinction of the bubble, the recessed portion 8 of the movable separating membrane 5 displaces into the second liquid path 4, thereby reducing the volume thereof and also reducing the refilling amount of the bubble generating liquid, whereby the refilling is completed promptly. Also, as the corner parts 8*a* of the recessed portion 8 have a function of suppressing the rebounding movement immediately after the displacement by bubble generation, the recessed portion 8 immediately returns to the initial state after displacement, thereby enabling high-speed drive.

Figure 4A:
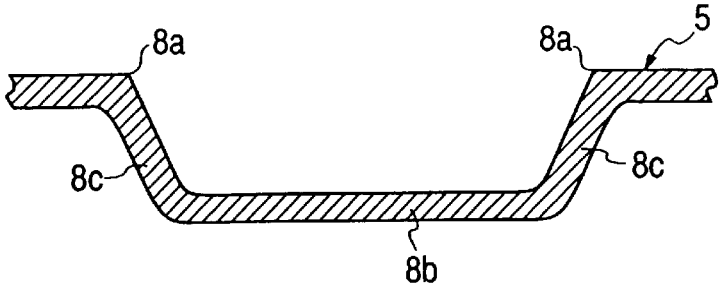
FIGS. 4A and 4B are magnified cross-sectional views along the liquid path showing the recessed portion of the movable separating membrane of the liquid discharging head of the present invention, respectively in an initial state and in a state at the maximum displacement.
Figure 4B:
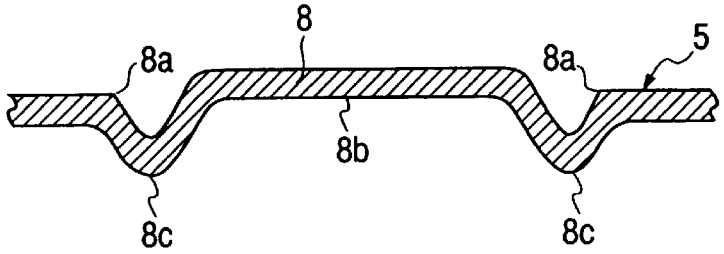
Figure 5A:
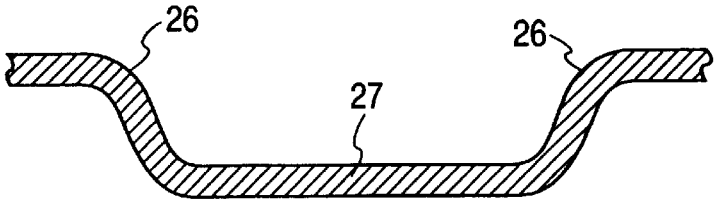
FIGS. 5A and 5B are similar views showing a reference example not provided with the corner part at the fulcrum of the recessed portion of the movable separating membrane, respectively in an initial state and in a state at the maximum displacement of the recessed portion.
Figure 5B:
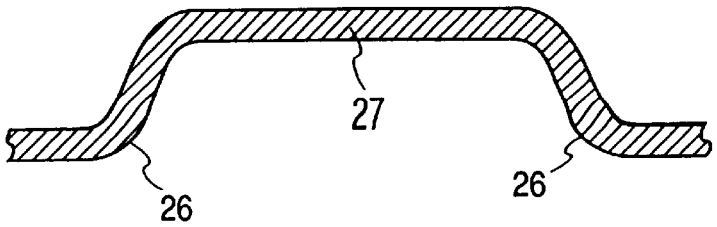
Figure 6:
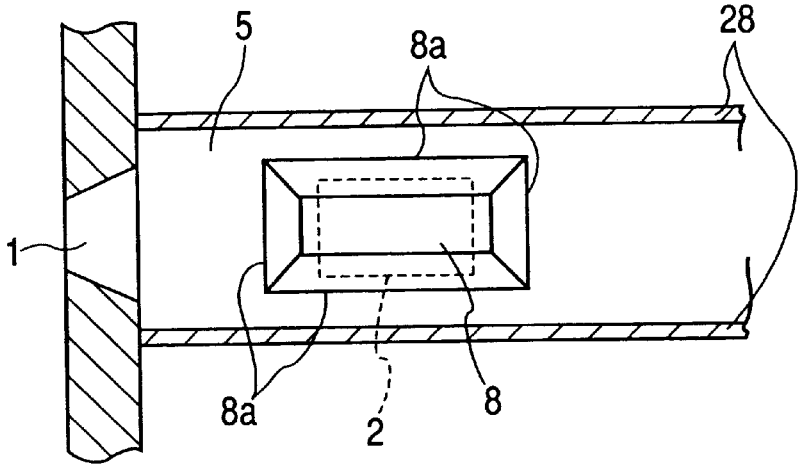
FIG. 6 is a cross-sectional view, parallel to the heat generating member, showing the liquid path of the liquid discharging head of the present invention.

FIGS. 4A and 4B are magnified cross-sectional views along the liquid path showing the recessed portion 8 of the movable separating membrane 5 of the liquid discharging head of the present invention, respectively in the initial state and in a state at the maximum displacement, while FIGS. 5A and 5B are similar views showing a reference example not provided with the corner parts at the fulcrums of the recessed portion 8 of the movable separating membrane 5, respectively in the initial state and in the state at maximum displacement of the recessed portion, and FIG. 6 is a cross-sectional view, parallel to the heat generating member, showing the liquid path of the liquid discharging head of the present invention.

In case the fulcrums 26 of the recessed portion do not have the corner parts as shown in FIGS. 5A and 5B and the bottom part 27 of the recessed portion assumes an inverted shape at the maximum displacement as shown in FIG. 5B, the recessed portion deforms with the fulcrums 26 as the inflection points.

On the other hand, in case the fulcrums of the recessed portion have the corner parts 8*a,* such corner parts 8*a* have an effect, in the initial state shown in FIG. 4A, of defining the initial shape always in a constant shape. Also at the maximum displacement shown in FIG. 4B, the shape is always constant because the deformation is not concentrated locally but is spread over a wide area in the vicinity of the corner parts. Thus the corner parts 8*a* define the shape at the initial state and at the maximum displacement, thereby achieving very stable liquid discharge and improving durability. The displacement governing area of the corner parts 8*a* will also be understood from FIG. 6.

Figure 7A:
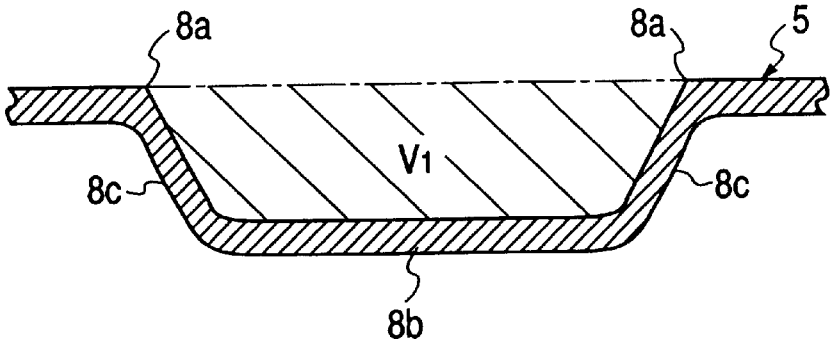
FIGS. 7A and 7B are magnified cross-sectional views along the liquid path showing the volume of the recessed portion of the movable separating membrane of the liquid discharging head of the present invention, respectively in an initial state and in a state at the maximum displacement.
Figure 7B:
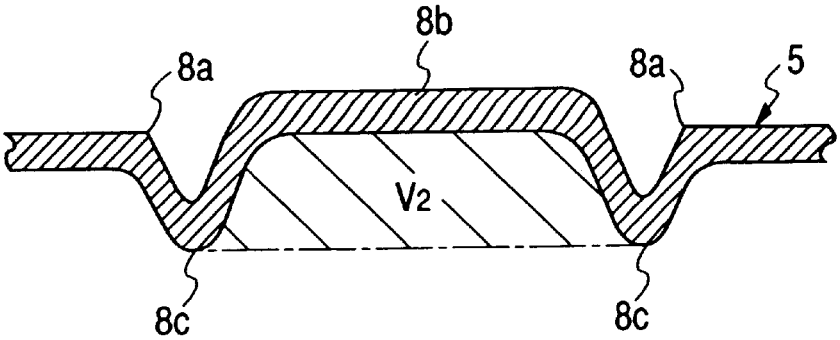

FIGS. 7A and 7B are magnified cross-sectional views along the liquid path showing the volume of the recessed portion 8 of the movable separating membrane 5 in the liquid discharging head of the present invention, respectively in an initial state and in a state at the maximum displacement.

In this embodiment, the driving conditions are so selected as to satisfy a condition V2<V1, wherein V1 is the volume of the recessed portion in the initial state shown in FIG. 7A and V2 is that at the maximum displacement shown in FIG. 7B.

Under the condition V2<V1, the movable separating member in the recessed portion 8 does not show elongation or contraction even at the maximum displacement. Consequently V1 and V2 remain always constant, thereby stabilizing the liquid discharge. The volume V1 of the recessed portion means a volume defined between the face of the movable separating membrane 5 at the side of the first liquid path and the bottom part 8*b* of the recessed portion 8 in the initial state, and the volume V2 means a volume surrounded by faces in contact with the inflection parts 8*c* of the recessed portion 8 and the bottom part 8*b* thereof at the maximum displacement. Also the "inflection part" used in the present specification and the appended drawings means, in the recessed portion of the movable separating membrane, a part showing the largest deformation at the maximum displacement.

The configuration of the present embodiment allows to employ different liquids for the discharge liquid and the bubble generating liquid and to discharge the discharge liquid only. Consequently, it is possible to satisfactorily discharge highly viscous liquid such as polyethylene glycol in which a sufficient discharging force cannot be obtained in the conventional configuration because of insufficient bubble generation under the application of heat, by supplying such liquid in the first liquid path 103 and supplying the second liquid path 104 with liquid capable of satisfactory bubble generation (for example a mixture of ethanol: water =4:6 with a viscosity of 1–2 cp).

Also as the bubble generating liquid, there can be selected liquid which does not generate a deposit such as kogation on the surface of the heat generating member under the influence of heat, in order to stabilize the bubble generation and ensuring satisfactory liquid discharge.

Furthermore, the configuration of the liquid discharging head of the present invention can discharge various liquid such as highly viscous liquid with an even higher discharge efficiency and an even higher discharging power, because of the effects explained in the foregoing embodiment.

Furthermore, liquid susceptible to heat can be discharged without thermal damage with a high discharge efficiency and a high discharging power as explained above, by supplying such liquid as the discharge liquid in the first liquid path 103 and supplying the second liquid path 104 with liquid stabler to heat capable of satisfactory bubble generation as the bubble generating liquid.

In the following there will be explained the configuration of an element board 110 provided with the heat generating members 102 for giving heat to the liquid.

Figure 8A:
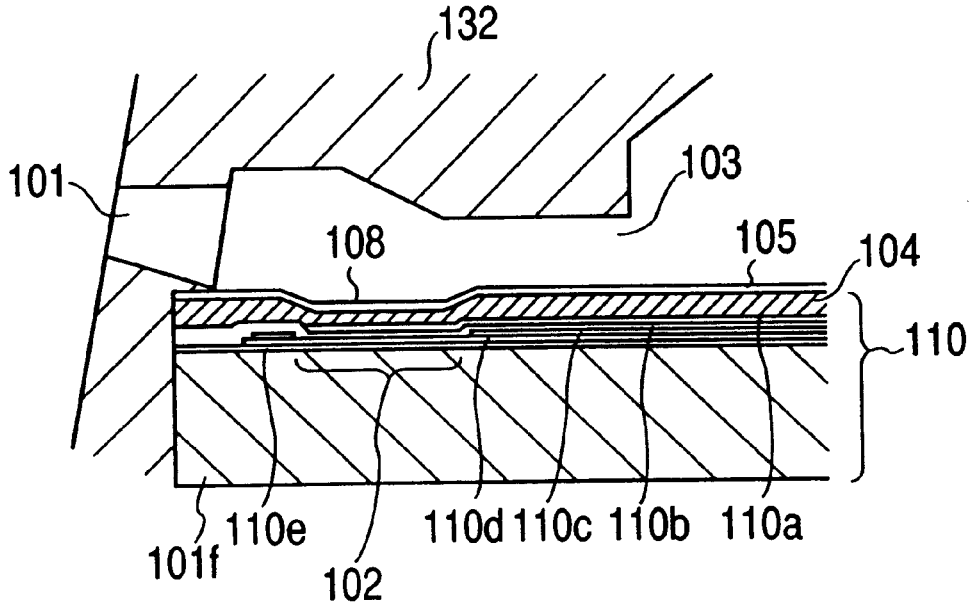
FIGS. 8A and 8B are cross-sectional views showing a configuration of the liquid discharging head of the present invention, respectively with a protective film to be explained later and without such protective film.
Figure 8B:
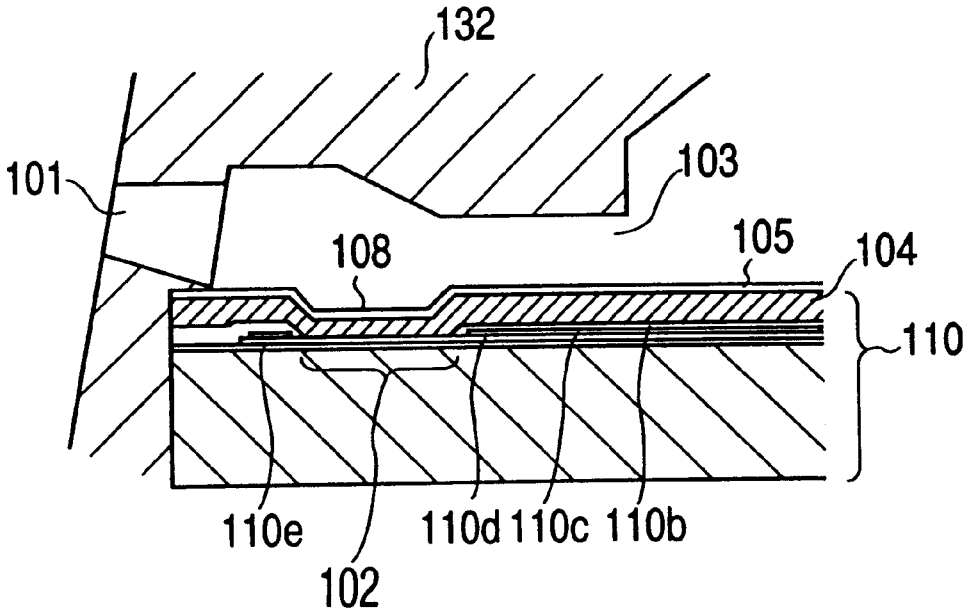

FIGS. 8A and 8B are longitudinal cross-sectional views showing a configuration of the liquid discharging head of the present invention, respectively with a protective film to be explained later and without such protective film.

As shown in FIGS. 8A and 8B, on an element board 110, there are provided a second liquid path 104, a movable separating membrane 105 constituting a partition wall, a movable member 131, a first liquid path 103, and a grooved member 132 provided with a groove constituting the first liquid path 103.

The element board 110 is composed by forming, on a substrate 110*f* such as of silicon, a silicon oxide film or a silicon nitride film 110*e* for the purpose of electrical insulation and heat accumulation, on which patterned are an electrical resistance layer 110*d* for example of hafnium boride ($HtB_2$), tantalum nitride (TaN) or tantalum-aluminum (TaAl) constituting the heat generating member of a thickness of 0.01 to 0.2 $\mu$m, and a wiring electrode 110*c* for example of aluminum of a thickness of 0.1 to 1.0 $\mu$m. A voltage is applied to the electrical resistance layer 110*d* from the two wiring electrodes 110*c* to generate heat by the current in the electrical resistance layer 110*d*. On the electrical resistance layer 110*d* between the wiring electrodes 110*c*, there are formed a protective layer 110*b* for example of silicon oxide or silicon nitride of a thickness of 0.1 to 0.2 $\mu$m and an anticavitation layer 110*a* for example of tantalum of a thickness of 0.1 to 0.6 $\mu$m to protect the electrical resistance layer 110*d* from various liquids such as the ink.

As the pressure or impact wave generated at the generation or extinction of the bubble is very strong and significantly deteriorates the service life of the hard and fragile oxide film, the anticativation layer 110*a* is composed of a metal such as tantalum (Ta).

There may also be adopted a configuration dispensing with the above-mentioned protective layer by the combination of the liquid, configuration of the liquid paths and the resistance material, as exemplified in FIG. 8B. An example of the material for the resistance layer not requiring such protective layer is iridium-tantalum-aluminum alloy. The present invention is particularly advantageous for the configuration without the protective layer, since the liquid for bubble generation can be selected for this purpose, separately from the discharge liquid.

Therefore, the heat generating member 102 in the above-described embodiment may be constructed with the electrical resistance layer (heat generating part) 110*d* only between the wiring electrodes 110*c* or with a protective layer for protecting the electrical resistance layer 110*d*.

In the present embodiment, the heat generating member 102 is provided with a heat generating part constituted by a resistance layer capable of heat generation in response to an electrical signal, but the present invention is not limited to such configuration and there may be employed any heat generating part capable of generating, in the bubble generating liquid, a bubble sufficient for discharging the discharge liquid. For example there may be employed a photothermal converting member for generating heat by receiving light such as from a laser, or a heat generating part for generating heat by receiving a high frequency radio wave.

The aforementioned element board 110 may be provided, in addition to the electrothermal converting members composed of the electrical resistance layer 110*d* constituting the heat generating parts and the wiring electrodes 110*c* for supplying the electrical resistance layer 110*d* with electrical signals, integrally with functional elements such as transistors, diodes, latches, shift registers etc. for selectively driving such electrothermal converting elements by a semiconductor process.

For discharging the liquid by driving the heat generating part of the electrothermal converting member provided on the aforementioned element board 110, a rectangular pulse is applied to the electrical resistance layer 110*d* through the wiring electrodes 110*d* thereby causing rapid heat generation in the electrical resistance layer 110*d*.

Figure 9:
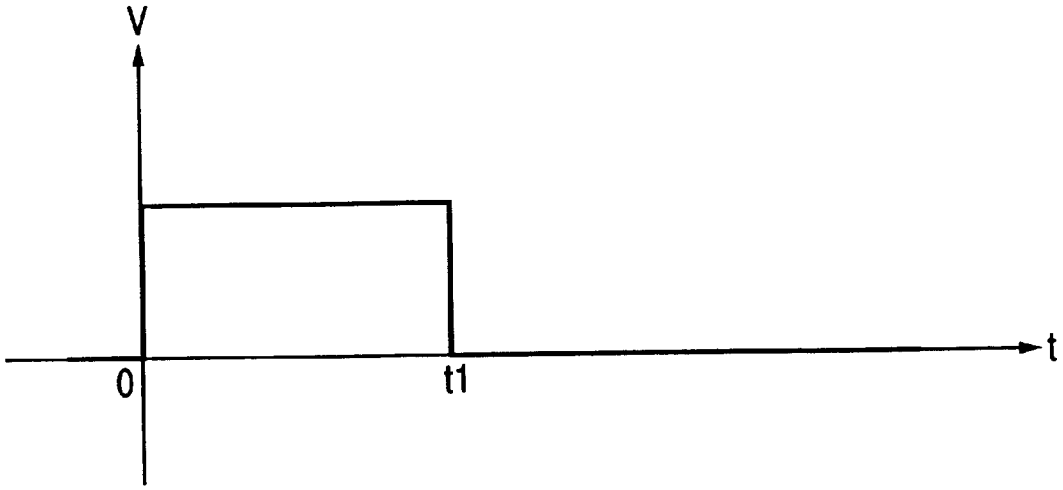
FIG. 9 is a wave form chart showing a voltage to be applied to the electrical resistance layer shown in FIGS. 8A and 8B.

FIG. 9 is a wave form chart showing the voltage to be applied to the electrical resistance layer 110*d* shown in FIGS. 8A and 8B. In the liquid discharging head of the above-described embodiment, the heat generating member is driven by applying an electrical signal of a voltage of 24 V, a pulse duration of 7 $\mu$sec and a current of 150 mA with a frequency of 6 kHz to discharge liquid ink from the discharge opening by the aforementioned functions. However the conditions of the driving signal in the present invention are not limited to those mentioned above but there may be employed any drive signal capable of appropriate bubble generation in the bubble generating liquid.

In the present invention, as explained in the foregoing, the liquid can be discharged with a discharging power and a discharge efficiency higher than in the conventional liquid discharging head. The bubble generating liquid can be of liquid of the aforementioned properties, such as methanol, ethanol, n-propanol, isopropanol, n-hexane, n-heptane, n-octane, toluene, xylene, methylene dichloride, trichlene, fleon TF, fleon BF, ethylether, dioxane, cyclohexane, methyl acetate, ethyl acetate, acetone, methylethylketone, water and mixtures thereof.

The discharge liquid may be composed of various liquid regardless of the bubble generating property or the thermal properties. There may also be employed liquid of low bubble generating property that cannot be easily discharged in the conventional configuration, liquid subject to deterioration by heat or highly viscous liquid. However the discharge liquid is desirably not hindering the liquid discharging operation, bubble generating operation or the function of the movable separating membrane by the discharge liquid itself or by a reaction with the bubble generating liquid.

The discharge liquid for recording may also be composed of highly viscous ink. Other examples of the discharge liquid include pharmaceuticals or perfumes which are susceptible to heat.

The recording operation was conducted by the combinations of the bubble generating liquid and the discharge liquid in the following compositions. As a result, records of high quality could be obtained by satisfactorily discharging not only the liquid of a viscosity in excess of 10 cp that could not be satisfactorily discharged in the conventional liquid discharging head but also the liquid of a viscosity as high as 150 cp.

| | | |
|---|---|---|
| Bubble generating liquid 1 | ethanol | 40 wt. % |
| | water | 60 wt. % |
| Bubble generating liquid 2 | water | 100 wt. % |
| Bubble generating liquid 3 | isopropyl alcohol | 10 wt. % |
| | water | 90 wt. % |
| Discharge liquid 1 | | |
| | carbon black (pigment ink; ca. 15 cp) | 5 wt. % |
| | styrene-acrylic acid-ethyl actylate copolymer (oxidation degree 140; weight-averaged molecular weight 8000) | 1 wt. % |
| | monoethanolamine | 0.25 wt. % |
| | glycerin | 6.9 wt. % |
| | thiodiglycol | 5 wt. % |
| | ethanol | 3 wt. % |
| | water | 16.75 wt. % |
| Discharge liquid 2 | | |
| | polyethyleneglycol 200 | 100 wt. % |
| Discharge liquid 3 | | |
| | polyethyleneglycol 600 | 100 wt. % |

With the aforementioned liquid that has conventionally considered difficult to discharge, the low discharge speed in such liquid increases the fluctuation in the direction of discharge, thus deteriorating the landing accuracy of the dot on the recording sheet. Also the discharge amount fluctuates because of the unstable discharge, and, because of these facts, a high-quality image was difficult to obtain. In the configuration of the above-described embodiment, the bubble generation can be achieved sufficiently and stably by the use of the bubble generating liquid. There can therefore be attained improvement in the landing accuracy of the liquid droplet and stabilization in the ink discharge amount, thus resulting in a significant improvement in the quality of the recorded image.

In the following there will be explained the method for producing the liquid discharging head of the present invention.

The head is basically prepared by forming a wall of the second liquid path on the element board, then mounting thereon the movable separating membrane thereon and mounting thereon a grooved member provided with a groove constituting the first liquid path. Otherwise it is prepared, after forming the wall of the second liquid path, by adhering thereon the grooved member on which the movable separating membrane is mounted in advance.

There will also be explained in detail the method of preparing the second liquid path.

At first, on an element substrate (silicon wafer), there was formed an electrothermal converting element including the heat generating member consisting for example of hafnium boride or tantalum nitride with an apparatus similar to that employed in the semiconductor manufacture, and the surface of the element substrate was then rinsed in order to improve the adhesion with photosensitive resin in a next step. Further improvement in adhesion can be achieved by surface modification of the element substrate for example with ultraviolet light-ozone, followed by spin coating for example of a silane coupling agent (A189 manufactured by Japan Unicar Co.) diluted to 1 wt. % with ethyl alcohol.

Then the substrate surface with thus improved adhesion was rinsed and laminated with an ultraviolet-sensitive resin film (Dry Film Ordil SY-318 manufactured by Tokyo Ohka Co.).

Then a photomask was placed on the dry film, and the portions to be left as the second liquid path walls were irradiated with the ultraviolet light through the photomask. The exposure was executed with an apparatus MPA-600 manufactured by Canon Inc., with an exposure amount of ca. 600 mJ/cm$^2$.

Then the dry film was developed with a developer (BMRC-3 manufactured by Tokyo Ohka Co.) consisting of a mixture of xylene and butyl cellosolve acetate to dissolve the unexposed portions, thereby leaving the portions hardened by exposure as the second liquid path walls. Further, the residue remaining on the substrate surface was eliminated by processing with an oxygen plasma ashing apparatus (MAS-800 manufactured by Alcantec Co.) for about 90 seconds, and the exposed portions were completely hardened by ultraviolet irradiation of 100 mJ/cm$^2$ for 2 hours at 150° C.

Through the above-described process, the second liquid path walls could be formed uniformly, with sufficient precision, on the plural heater boards (element boards) prepared by dividing the above-mentioned silicon substrate. More specifically, the silicon substrate was cut into respective heater boards 1 with a dicing machine (AWD-4000 manufactured by Tokyo Seimitsu Co.) equipped with a diamond blade of a thickness of 0.05 mm. The separated heater board was fixed on an aluminum base plate with an adhesive material (SE4400 manufactured by Toray Co.).

The printed circuit board adhered in advance to the aluminum base plate and the heater board were connected with aluminum wires of a diameter of 0.05 mm.

Then, on the heater board thus obtained, a jointed member of the grooved member and the movable separating membrane was positioned and adhered by the above-described process. More specifically, the grooved member provided with the movable separating membrane and the heater board are mutually positioned and fixed with a pressing spring, then the ink/bubble generating liquid supply member is adhered to the aluminum base plate, and the gaps between the aluminum wires and among the grooved member, heater board and ink/bubble generating liquid supply member were sealed with a silicone sealant (TSE399 manufactured by Toshiba Silicone Co.).

The above-described process allowed to prepare the second liquid paths with sufficient precision, without positional aberration with respect to the heaters of the heater board. In particular, the positional precision between the first liquid path and the movable member can be improved by adhering the grooved member and the movable separating membrane in advance. Such highly precise manufacturing technology stabilizes the discharge, thereby improving the print quality, and allows collective manufacture on the wafer, thereby enabling mass production with a low cost.

In the second embodiment, the second liquid paths are formed with the ultraviolet-setting dry film, but they can also be obtained by laminating a resin having absorption band in the ultraviolet region, particularly in the vicinity of 248 nm, then hardening the resin and directly eliminating the resin corresponding to the second liquid paths with an excimer laser.

Also the first liquid paths etc. were prepared by adhering a grooved top plate, provided with an orifice plate having the discharge openings, grooves constituting the first liquid paths and a recess constituting a first common liquid chamber commonly communicating with plural first liquid paths and serving the supply the first liquid to such liquid paths, to the jointed member of the aforementioned substrate and the movable separating membrane. The movable separating membrane is fixed by being sandwiched between the grooved top plate and the second liquid path walls. The movable separating membrane need not necessarily be fixed to the substrate but may be fixed to the grooved top plate and then to the substrate.

The movable separating membrane 105 is preferably composed of a resinous material with satisfactory heat resistance, solvent resistance and molding property and capable of forming a thin film, represented by recent engineering plastics such as polyimide, polyethylene, polypropylene, polyamide, polyethylene terephthalate, melamine resin, phenolic resin, polybutadiene, polyurethane, polyethyletherketone, polyethersulfone, polyallylate, silicone rubber, polysulfone, fluorinated resin etc., compounds thereof, or a metal with satisfactory durability, heat resistance and solvent resistance such as silver, nickel, gold, iron, titanium, aluminum, platinum, tantalum, stainless steel, phosphor bronze or compounds thereof, or silicone or compounds thereof.

Figure 10A:
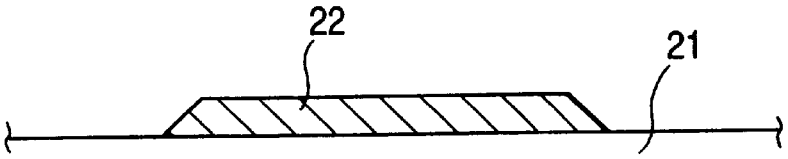
FIGS. 10A and 10B are views showing a process for preparing the movable separating membrane of the liquid discharging head of the present invention.
Figure 10B:
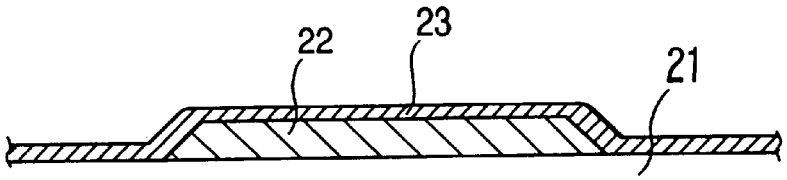
Figure 11A:
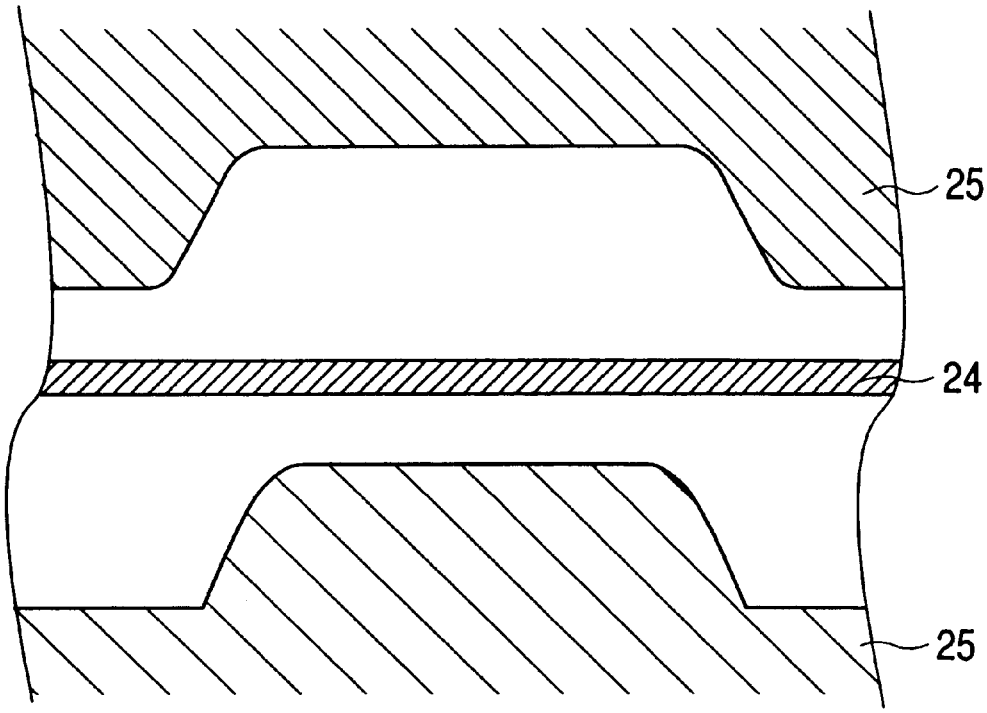
FIGS. 11A and 11B are views showing another process for preparing the movable separating membrane of the liquid discharging head of the present invention.
Figure 11B:
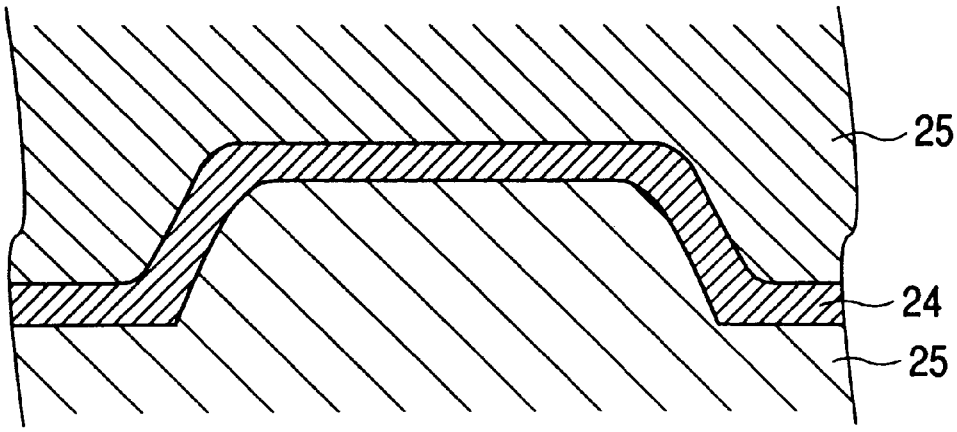

FIGS. 10A and 10B illustrate the process for preparing the movable separating membrane, and FIGS. 11A and 11B illustrate another process for preparation.

At first, as shown in FIG. 10A, a mold 22 corresponding to the recessed portion of the movable separating membrane was formed with a metal or a resinous material on a silicon mirror wafer 21. Then a releasing agent was coated on the mold 22, and liquid polyimide resin was spin coated thereon to form a film 23 as shown in FIG. 10B.

Then the film 23 was peeled off from the mirror wafer 11 and was positioned and fixed on the substrate on which the aforementioned second liquid path was formed, thereby obtaining the movable separating membrane.

However the movable separating membrane can also be prepared by other methods. For example, the movable separating membrane can be formed by preparing a commercially available thin film 24 and molds 25 for forming the recessed portion as shown in FIG. 11A, and pressing the thin film 24 between the molds 25 as shown in FIG. 11B and causing plastic deformation by heat.

FIGS. 12A to 12F are cross-sectional views, along the liquid path, showing another embodiment of the liquid discharging head of the present invention, while FIGS. 13A to 13F are magnified cross-sectional views of the vicinity of the recessed portion of the movable separating membrane shown in FIGS. 12A to 12F, and FIG. 14 is a partially broken perspective view of the liquid discharging head shown in FIGS. 12A to 12F and 13A to 13F.

In the present embodiment, as shown in FIGS. 12A to 12F, a first liquid path 3 communicating with a discharge opening 1 is filled with first liquid supplied from a first common liquid chamber 143, while a second liquid path 4 containing a bubble generating area 7 is filled with bubble generating liquid which generates a bubble upon receiving thermal energy by a heat generating member 2. Between the first liquid path 3 and the second liquid path 4 there is provided a movable separating membrane 5 for mutually separating the first and second liquid paths. The movable separating membrane 5 is provided, in a portion thereof opposed to the bubble generating area 7, with a recessed portion 8 having corner parts 8*a* at the fulcrums thereof, thus forming an expansion in the first liquid path 3. The movable separating membrane 5 is fixed to an orifice plate 9 to prevent mixing of two liquids. In the second liquid path 4, the bubble generating area 7 is constituted by the vicinity of the projected area of the heat generating member 2.

As shown in FIGS. 13A to 13F, the recessed portion 8 of the movable separating membrane 5 is provided with inflection parts 8*c* between the corner parts 8*a* and the bottom part 8*b*, and the thickness (W8*c*) of the inflection parts 8*c* is made smaller than that (W8*b*) of the bottom part 8*b*. The "inflection part" used in the present specification and in the appended drawings means a part showing largest deformation in the recessed portion of the movable separating membrane at the maximum displacement thereof.

Figure 14:
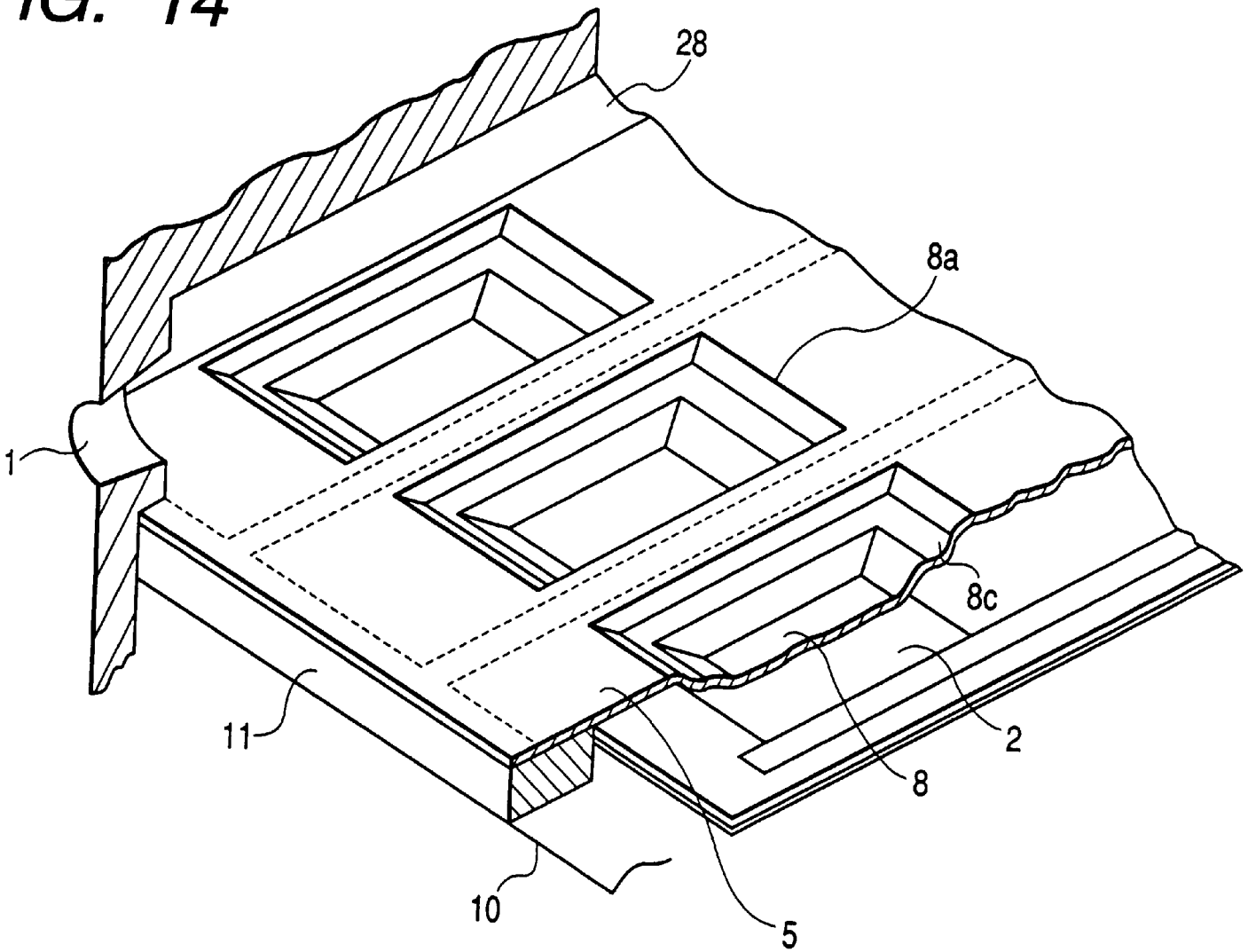
FIG. 14 is a partially broken perspective view of the liquid discharging head shown in FIGS. 12A to 12F and 13A to 13F.

As shown in FIG. 14, the heat generating member 2 is provided in an array of plural units on an element board 10, on which plural second liquid paths 4 are provided respectively corresponding to the heat generating members 2. A support member 11 supporting the movable separating membrane 5 serves also as a wall for defining and forming the second liquid paths 4. The movable separating membrane 5 is provided with plural recessed portions 8, respectively corresponding to the bubble generating areas 7 positioned in the vicinity of the bubble generating areas 7 which are in the vicinity of the projected areas of the heat generating members 2. The first liquid path 3 is provided in plural units, so as to respectively contain the recessed portions 8. In FIG. 14, however, the positions of walls 28 for defining the first liquid paths are represented by broken lines.

The present invention is based on the movement of the movable separating membrane 5, and the movable separating membrane 5 itself is provided with the recessed portion 8 which is displaced toward the first liquid path 3 by the growth of a bubble generated on the surface of the heat generating member 2.

Figure 12A:
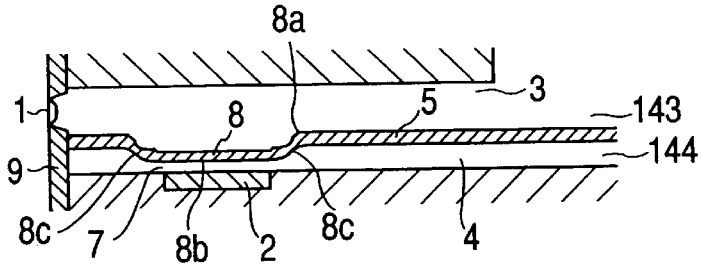
FIGS. 12A, 12B, 12C, 12D, 12E and 12F are cross-sectional views along the liquid path showing another embodiment of the liquid discharging head of the present invention.
Figure 13A:
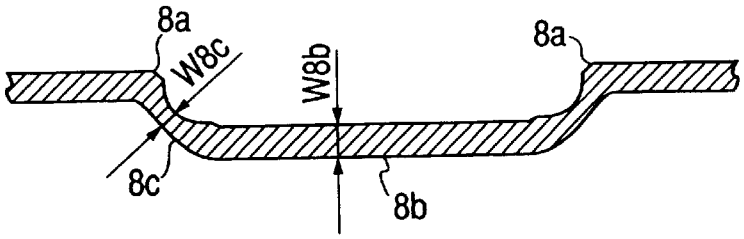
FIGS. 13A, 13B, 13C, 13D, 13E and 13F are magnified cross-sectional views in the vicinity of the recessed portion of the movable separating membrane shown in FIGS. 12A to 12F.

In an initial state shown in FIGS. 12A and 13A, the liquid in the first liquid path 3 is retracted to the vicinity of the discharge opening 1 by the capillary force. In the present embodiment, the discharge opening 1 is provided at the downstream position, in the liquid flow direction in the first liquid path 3, with respect to the projected area of the heat generating member 2 onto the first liquid path 3.

Figure 12B:
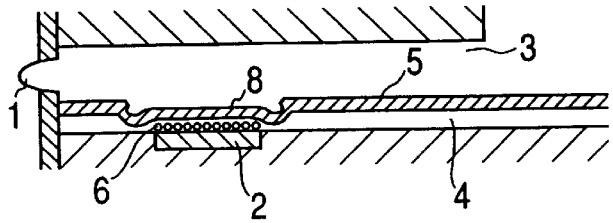
Figure 13B:
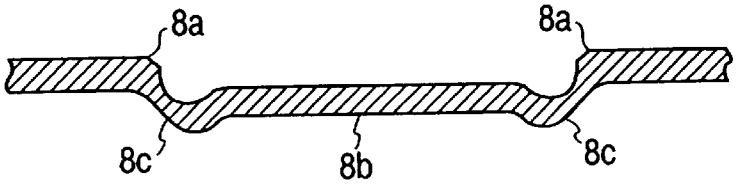

When thermal energy is given to the heat generating member 2 (consisting of a heat-generating resistance member of 40×105 $\mu$m in the present embodiment) in this state, the heat generating member 2 is rapidly heated whereby the surface thereof in contact with the second liquid in the bubble generating area heats the liquid and generates a bubble therein (FIGS. 12B and 13B). A bubble 6 thus formed is based on a film boiling phenomenon as described in the U.S. Pat. No. 4,723,129 and is generated with an extremely high pressure over the entire area of the heat generating member. The generated pressure is transmitted as a pressure wave in the second liquid in the second liquid path 4 and acts on the movable separating membrane 5, whereby the recessed portion 8 thereof is deformed, starting from the thinner inflection parts 8*c*, to initiate the discharge of the first liquid in the first liquid path 3. However the corner parts 8*a* formed at the fulcrums of the recessed portion 8 are not involved in such deformation.

Figure 12C:
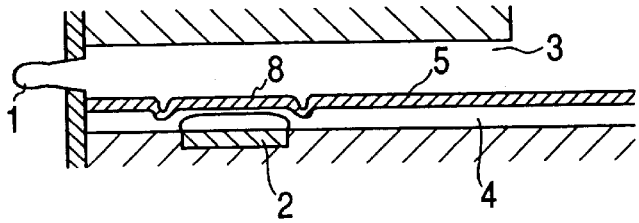
Figure 13C:
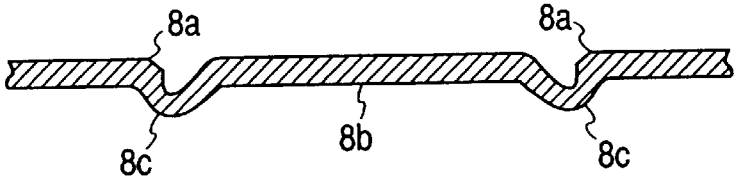

The bubble generated on the entire surface of the heat generating member 2 rapidly grows to assume a film shape (FIGS. 12C and 13C). The expansion of the bubble 6 with an extremely high pressure in the initial stage of generation causes a further deformation of the recessed portion 8 of the movable separating membrane 5, whereby the first liquid in the first liquid path 3 is further discharged from the discharge opening 1.

Figure 12D:
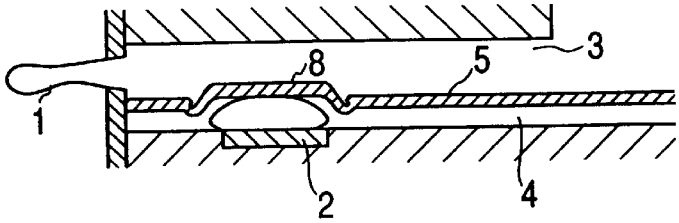
Figure 13D:
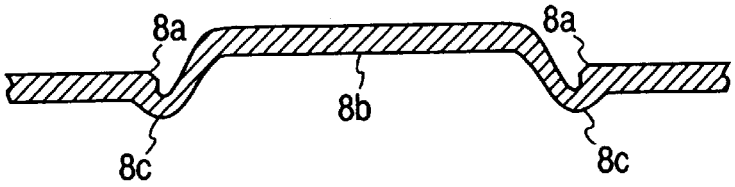

When the further growth of the bubble 6 thereafter, the deformation proceeds to such a level that the entire recessed portion 8, excluding the vicinity of the corner parts 8*a* of the membrane 5, enters the first liquid path 3 (FIGS. 12D and 13D). Since the above-described displacement of the recessed portion 8 from the initial state to the maximum displacement is facilitated by the inflection parts 8*c* thinner than other parts of the recessed portion 8, the pressure caused by bubble generation can be efficiently guided to the discharge opening, thereby improving the discharge efficiency.

Figure 12E:
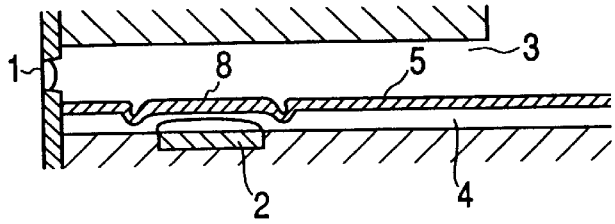
Figure 13E:
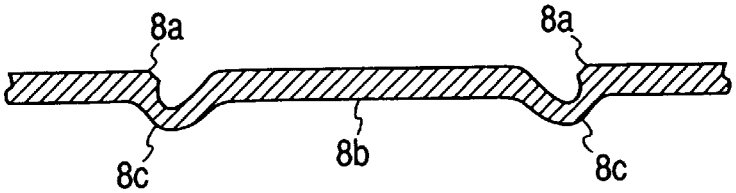

When the bubble 6 starts to contract thereafter, the recessed portion 8 of the movable separating membrane 5 starts to return to the position before deformation (FIGS. 12E and 13E).

Figure 12F:
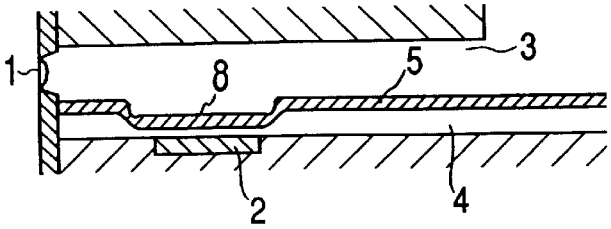
Figure 13F:
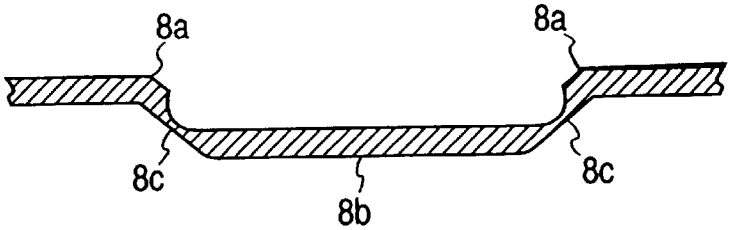

Subsequently, the recessed portion 8 of the movable separating membrane 5 promptly returns to the initial state shown in FIGS. 12F and 13F by the self returning force exerted by the non-deformed corner parts 8*a,* whereby the liquid refilling in the first liquid path 3 is accelerated. Also, with the extinction of the bubble, the recessed portion 8 of the movable separating membrane 5 displaces into the second liquid path 4, thereby reducing the volume thereof and also reducing the refilling amount of the bubble generating liquid, whereby the refilling is completed promptly. Also, as the corner parts 8*a* of the recessed portion 8 have a function of suppressing the rebounding movement immediately after the displacement by bubble generation, the recessed portion 8 immediately returns to the initial state after displacement, thereby enabling high-speed drive.

Figure 15A:
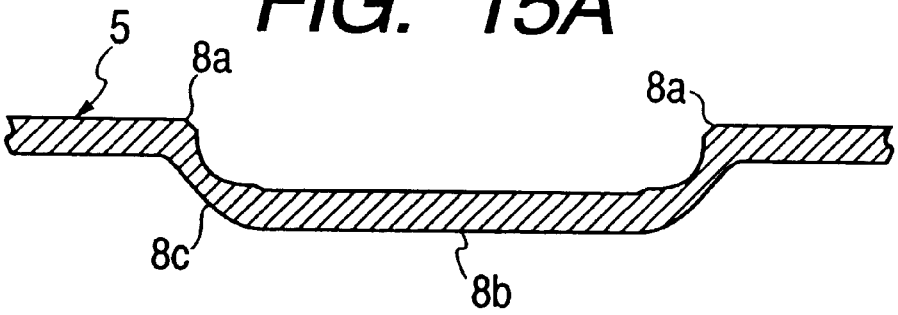
FIGS. 15A and 15B are magnified cross-sectional views along the liquid path showing the recessed portion of the movable separating membrane in another embodiment of the liquid discharging head of the present invention, respectively in an initial state and in a state at the maximum displacement.
Figure 15B:
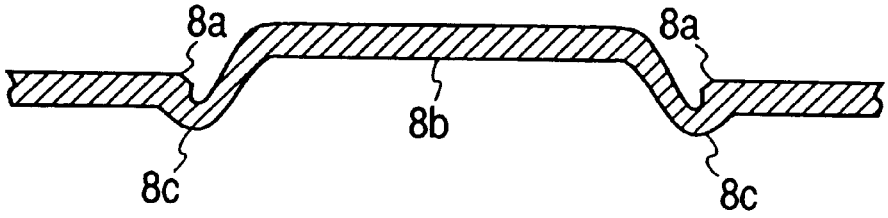
Figure 16:
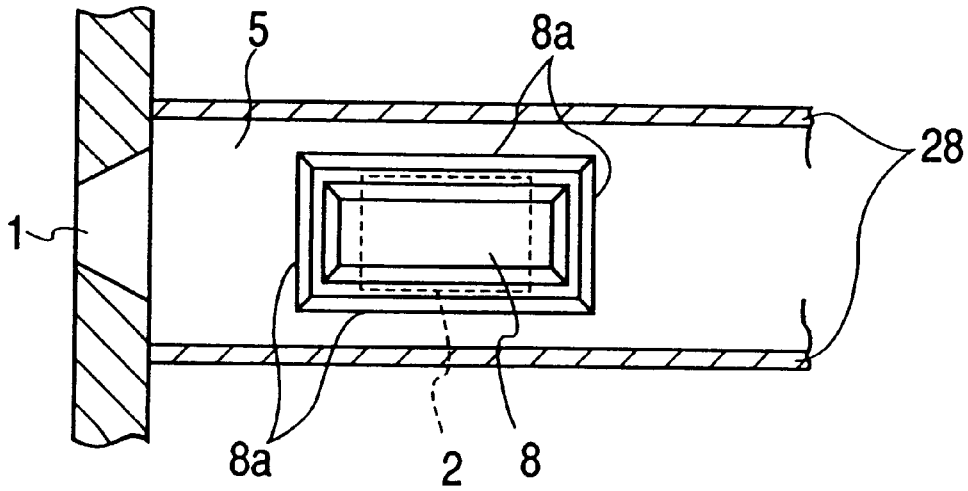
FIG. 16 is a cross-sectional view, parallel to the heat generating member, showing the liquid path in another embodiment of the liquid discharging head of the present invention.

FIGS. 15A and 15B are magnified cross-sectional views along the liquid path showing the recessed portion 8 of the movable separating membrane 5 in the liquid discharging head of the other embodiment of the present invention, respectively in the initial state and in a state at the maximum displacement, while FIG. 16 is a cross-sectional view, parallel to the heat generating member, of the liquid discharging head of the other embodiment of the present invention.

In case the fulcrums 2 of the recessed portion do not have the corner parts as shown in FIGS. 5A and 5B and the bottom part 27 of the recessed portion assumes an inverted shape at the maximum displacement as shown in FIG. 5B, the recessed portion deforms with the fulcrums 26 as the inflection points.

On the other hand, in case the fulcrums of the recessed portion have the corner parts 8*a,* such corner parts 8*a* have an effect, in the initial state shown in FIG. 15A, of defining the initial shape always in a constant shape. Also at the maximum displacement shown in FIG. 15B, the shape is always constant because the deformation is not concentrated locally but is spread over a wide area in the vicinity of the corner parts. Thus the corner parts 8*a* define the shape at the initial state and at the maximum displacement, thereby achieving very stable liquid discharge and improving durability. The displacement governing area of the corner parts 8*a* will also be understood from FIG. 16.

Besides, the presence of the thinner inflection part 8*c* between the corner part 8*a* and the bottom part 8*b* of the recessed portion facilitates the deformation of the recessed portion, thereby allowing to efficiently guide the pressure by bubble generation to the discharge opening and improving the discharge efficiency. In the liquid discharging head employing the separating membrane, as such membrane is sandwiched between the liquid path walls for forming the first and second liquid paths respectively above and below the separating membrane, it becomes less deformable with a higher density of the nozzles since the movable separating membrane present between the liquid path walls becomes narrower. However the more easily deformable recessed portion allows to provide a liquid discharging head capable of sufficiently adapting to the nozzles arranged at a high density.

Furthermore, the configuration of the present embodiment allows to employ different liquids for the discharge liquid and the bubble generating liquid and to discharge the discharge liquid only. Consequently, it is possible to satisfactorily discharge highly viscous liquid such as polyethylene glycol in which a sufficient discharging force cannot be obtained in the conventional configuration because of insufficient bubble generation under the application of heat, by supplying such liquid in the first liquid path 103 and supplying the second liquid path 104 with liquid capable of satisfactory bubble generation (for example a mixture of ethanol: water=4:6 with a viscosity of 1 to 2 cp).

Also as the bubble generating liquid, there can be selected liquid which does not generate a deposit such as kogation on the surface of the heat generating member under the influence of heat, in order to stabilize the bubble generating and ensuring satisfactory liquid discharge. Furthermore, the configuration of the liquid discharging head of the present invention can discharge various liquid such as highly viscous liquid with an even higher discharge efficiency and an even higher discharging power, because of the effects explained in the foregoing embodiment.

Furthermore, liquid susceptible to heat can be discharged without thermal damage with a high discharge efficiency and a high discharging power as explained above, by supplying such liquid as the discharge liquid in the first liquid path 103 and supplying the second liquid path 104 with liquid stabler to heat capable of satisfactory bubble generation as the bubble generating liquid.

Figure 17A:
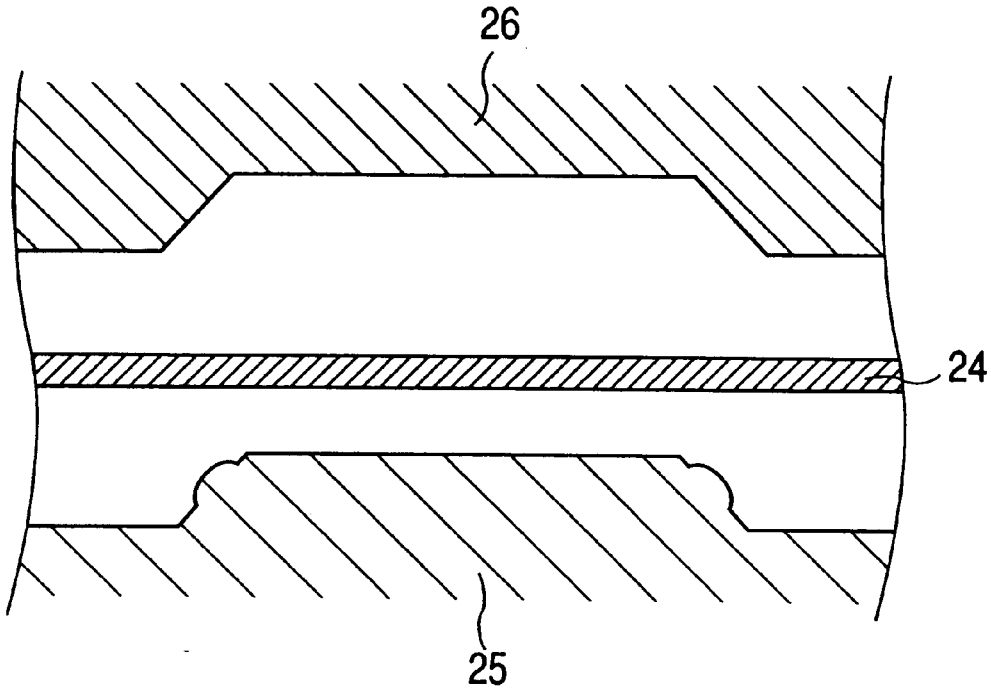
FIGS. 17A and 17B are views showing a process for preparing the movable separating membrane in another embodiment of the liquid discharging head of the present invention.
Figure 17B:
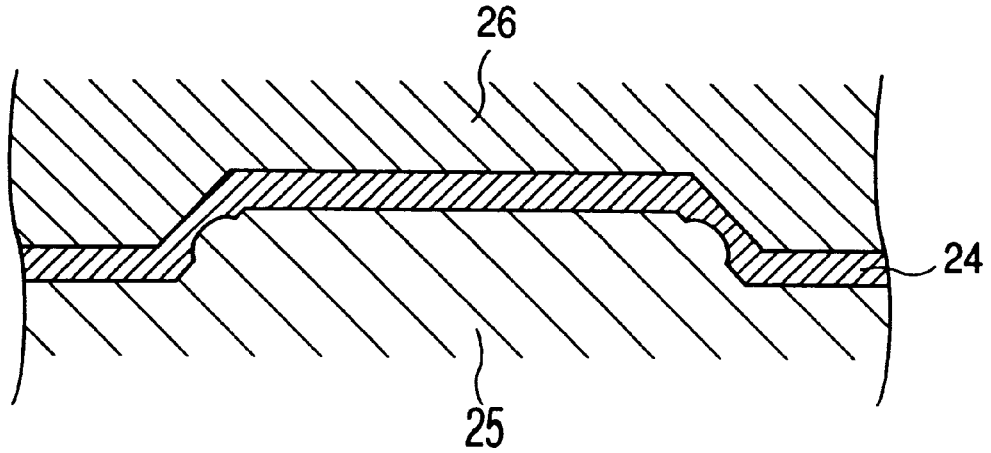

FIGS. 17A and 17B illustrate another example of the process for producing the movable separating membrane. At first, as shown in FIG. 17A, there were prepared a commercially available thin film 24 for forming the movable separating membrane and a male mold 25 and a female mold 26 for forming the recessed portion, and, the film 24 was pressed to the female mold 26 as shown in FIG. 17B and was subjected to plastic deformation by heat to obtain the movable separating membrane with the recessed portion.

Figure 18A:
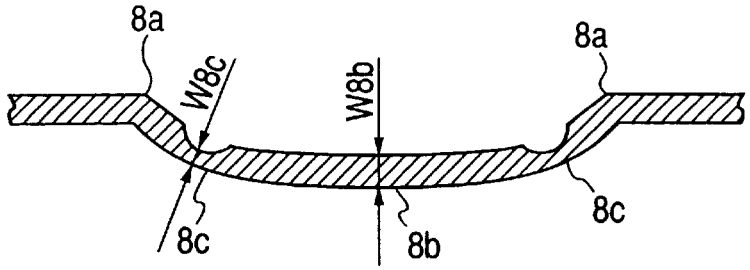
FIGS. 18A, 18B, 18C, 18D and 18E are cross-sectional views along the liquid path showing another embodiment of the movable separating membrane of the liquid discharging head of the present invention.
Figure 18B:
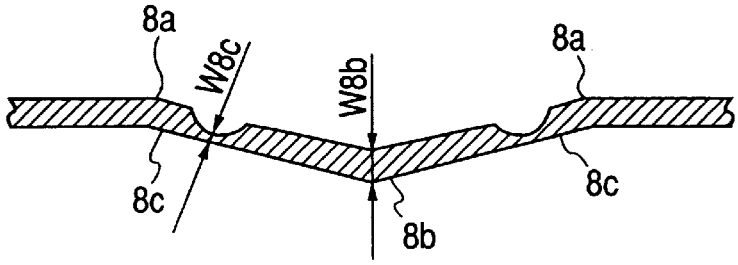
Figure 18C:
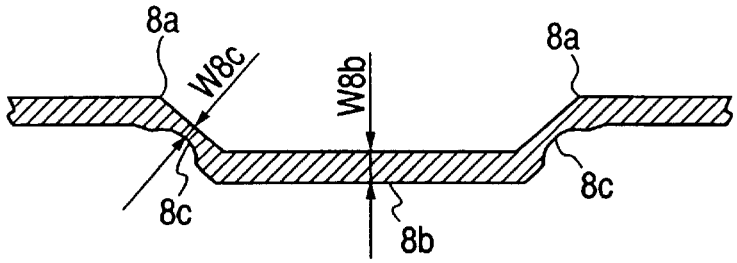
Figure 18D:
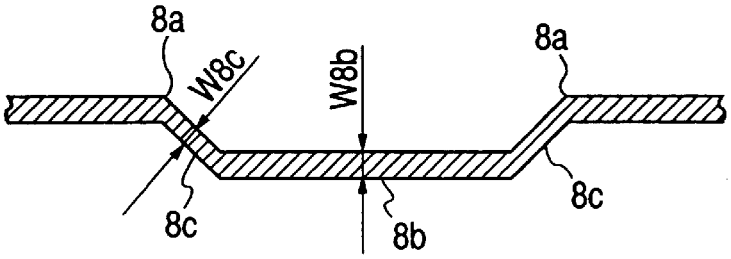
Figure 18E:
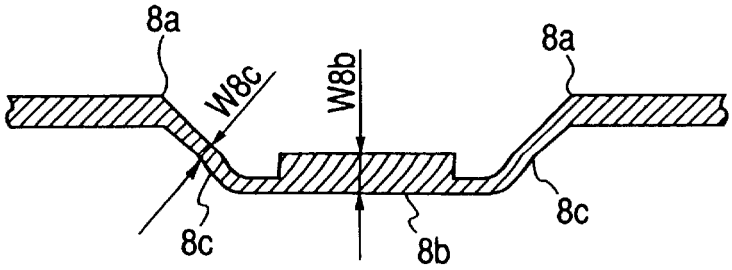

FIGS. 18A to 18E are cross-sectional views, transversal to the liquid path, showing still other embodiment of the movable separating membrane of the present invention. FIG. 18A shows a separating membrane with a semi-oval recessed portion, while FIG. 18B shows a separating membrane a V-shaped recessed portion, wherein a thinner inflection part 8*c* is provided between each corner part 8*a* and bottom part 8*b*. FIGS. 18C to 18E show separating membranes with a trapezoidal recessed portion. In FIG. 18C a thinner part is formed by a curved notch. In FIG. 18D, the entire rising part is made thinner than other parts, and, in FIG. 18E, the entire rising part and a part of the bottom are made thinner than other parts. Also these configurations facilitate deformation of the recessed portion of the movable separating membrane, thereby efficiently guiding the pressure by bubble generation to the discharge opening and improving the discharge efficiency.

Figure 19A:
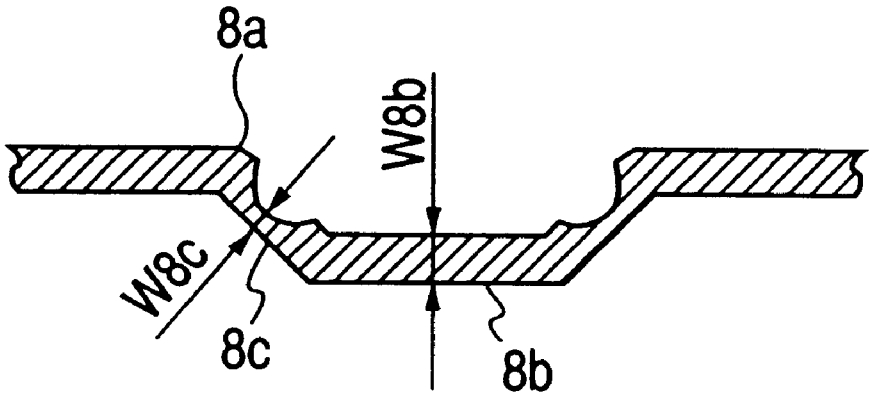
FIGS. 19A and 19B are cross-sectional views perpendicular to the liquid path showing another embodiment of the movable separating membrane of the liquid discharging head of the present invention.
Figure 19B:
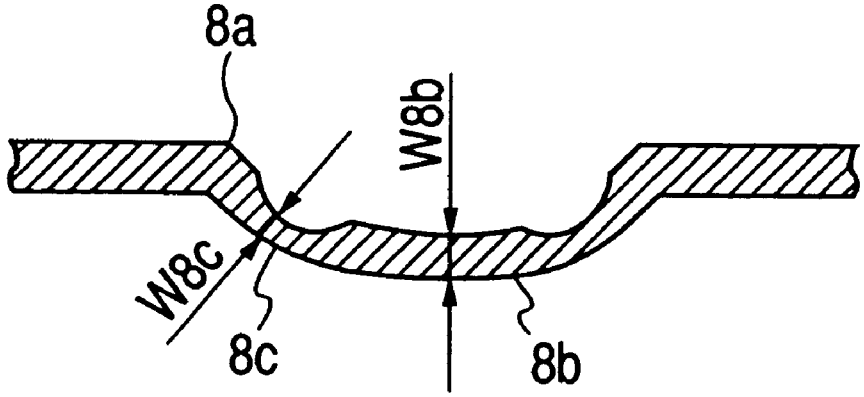

FIGS. 19A and 19B are cross-sectional views, perpendicular to the liquid path, showing still other embodiments of the movable separating membrane of the present invention. In the illustrated cross section perpendicular to the liquid path, thinner inflection parts 8*c* are provided between the corner parts 8*a* and the bottom part 8*b* to obtain effects similar to those in the above-described embodiments.

FIGS. 20A to 20F are magnified cross-sectional views of the vicinity of the recessed portion of the movable separating membrane in another embodiment of the present invention.

Figure 20A:
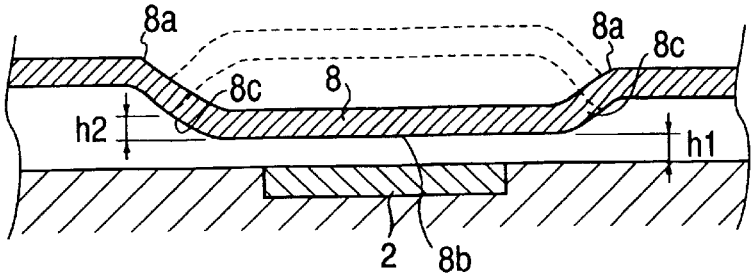
FIGS. 20A, 20B, 20C, 20D, 20E and 20F are magnified cross-sectional views in the vicinity of the recessed portion of the movable separating membrane in another embodiment of the liquid discharging head of the present invention.

In this embodiment, as shown in FIG. 20A, the recessed portion of the movable separating membrane 5 is so formed as to satisfy a condition h2≧h1, wherein h1 is the height from the heat generating member 2 to the bottom part 8*b* of the recessed portion in the still state and h2 is the height from bottom part 8*b* of the recessed portion to the inflection part 8*c* thereof in the still state. For example if h2 is 20 μm, h1 is preferably within a range of 5 to 10 μm. The "inflection part" used in the present specification and the appended drawings means, in the recessed portion of the movable separating membrane, a part showing the largest deformation at the maximum displacement.

In an initial state shown in FIG. 20A, the liquid in the first liquid path 3 is retracted to the vicinity of the discharge opening 1 by the capillary force. In the present embodiment, the discharge opening 1 is provided at the downstream position, in the liquid flow direction in the first liquid path 3, with respect to the projected area of the heat generating member 2 onto the first liquid path 3.

Figure 20B:
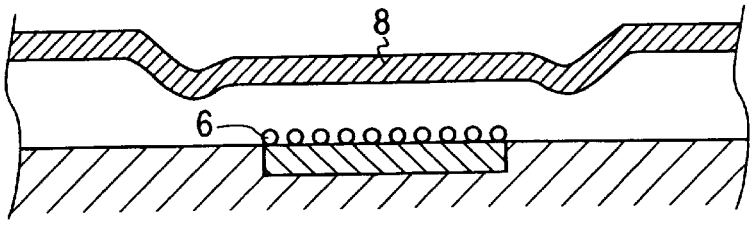

When thermal energy is given to the heat generating member 2 (consisting of a heat-generating resistance member of 40×105 μm in the present embodiment) in this state, the heat generating member 2 is rapidly heated whereby the surface thereof in contact with the second liquid in the bubble generating area heats the liquid and generates a bubble therein (FIG. 20B). A bubble 6 thus formed is based on a film boiling phenomenon as described in the U.S. Pat. No. 4,723,129 and is generated with an extremely high pressure over the entire area of the heat generating member. The generated pressure is transmitted as a pressure wave in the second liquid in the second liquid path 4 and acts on the movable separating membrane 5. As the height h2 from the bottom part 8*b* of the recessed portion 8 to the inflection part 8*c* thereof is selected equal to or larger than the height h1 from the heat generating member 2 to the bottom part 8*b* of the recessed portion 8, the pressure by bubble generation is transmitted to the movable separating membrane 5 before it can escape to the upstream and downstream sides of the second liquid path 4, so that the pressure can be efficiently transmitted to the movable separating membrane 5. The transmission of the pressure by bubble generation to the movable separating membrane causes deformation of the recessed portion 8 thereof, thereby initiating the discharge of the first liquid in the first liquid path 3. However the corner parts 8*a* formed at the fulcrums of the recessed portion 8 are not involved in such deformation.

Figure 20C:
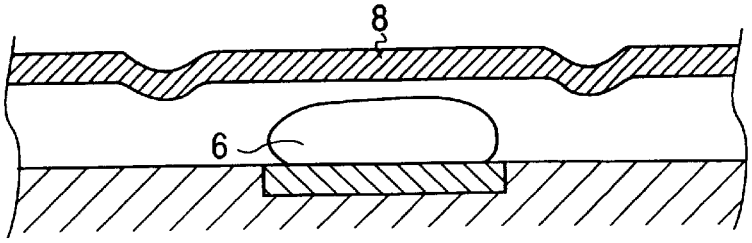

The bubble generated on the entire surface of the heat generating member 2 rapidly grows to assume a film shape (FIG. 20C). The expansion of the bubble 6 with an extremely high pressure in the initial stage of generation causes a further deformation of the recessed portion 8 of the movable separating membrane 5, whereby the first liquid in the first liquid path 3 is further discharged from the discharge opening 1.

Figure 20D:
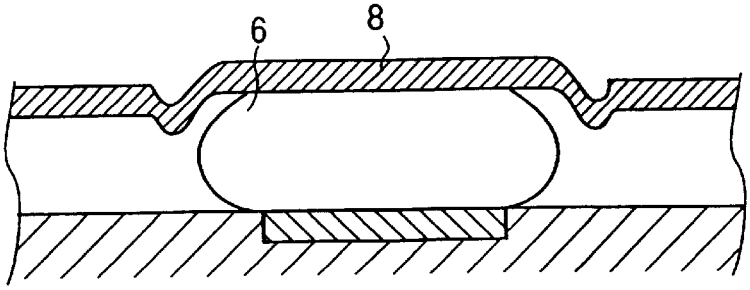

With the further growth of the bubble 6 thereafter, the deformation proceeds to such a level that the entire recessed portion 8, excluding the vicinity of the corner parts 8*a* of the membrane 5, enters the first liquid path 3 (FIG. 20D).

Figure 20E:
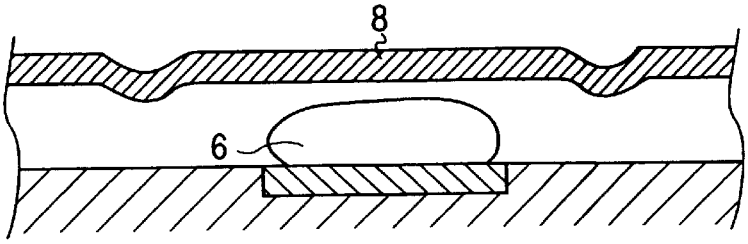

When the bubble 6 starts to contract thereafter the recessed portion 8 of the movable separating membrane 5 starts to return to the position before deformation (FIG. 20E).

Figure 20F:
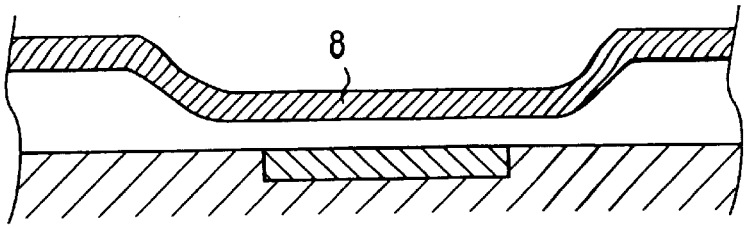

Subsequently, the recessed portion 8 of the movable separating membrane 5 promptly returns to the initial state shown in FIG. 20F by the self returning force exerted by the non-deformed corner parts 8*a*, whereby the liquid refilling in the first liquid path 3 is accelerated.

Also, with the extinction of the bubble, the recessed portion 8 of the movable separating membrane 5 displaces into the second liquid path 4, thereby reducing the volume thereof and also reducing the refilling amount of the bubble generating liquid, whereby the refilling is completed promptly. Also, as the corner parts 8*a* of the recessed portion 8 have a function of suppressing the rebounding movement immediately after the displacement by bubble generation, the recessed portion 8 immediately returns to the initial state after displacement, thereby enabling high-speed drive.

FIGS. 21A to 21F are magnified cross-sectional views of the vicinity of the recessed portion of the movable separating membrane in still another embodiment of the present invention.

Figure 21A:
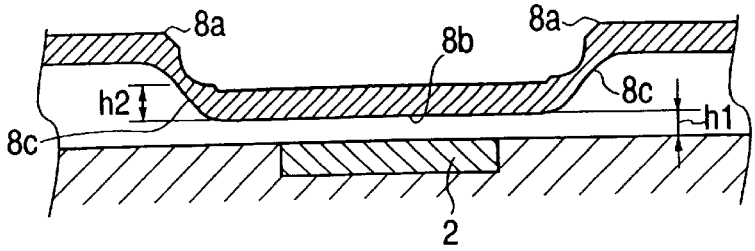
FIGS. 21A, 21B, 21C, 21D, 21E and 21F are magnified cross-sectional views in the vicinity of the recessed portion of the movable separating membrane in still another embodiment of the liquid discharging head of the present invention.

In this embodiment, as shown in FIG. 21A, the recessed portion 8 of the movable separating membrane 5 has an inflection part 8*c* between the corner part 8*a* and the bottom part 8*b*, with a thickness smaller in the inflection part 8*c* than in the bottom part 8*b*. Also as shown in FIG. 20A, the recessed portion of the movable separating membrane 5 is so formed as to satisfy a condition h2≧h1, wherein h1 is the height from the heat generating member 2 to the bottom part 8*b* of the recessed portion in the still state and h2 is the height from bottom part 8*b* of the recessed portion to the inflection part 8*c* thereof in the still state. For example if h2 is 20 μm, h1 is preferably within a range of 5 to 10 μm. Other configurations are same as those in the foregoing embodiment.

In an initial state shown in FIG. 21A, the liquid in the first liquid path 3 is retracted to the vicinity of the discharge opening 1 by the capillary force. In the present embodiment, the discharge opening 1 is provided at the downstream position, in the liquid flow direction in the first liquid path 3, with respect to the projected area of the heat generating member 2 onto the first liquid path 3.

Figure 21B:
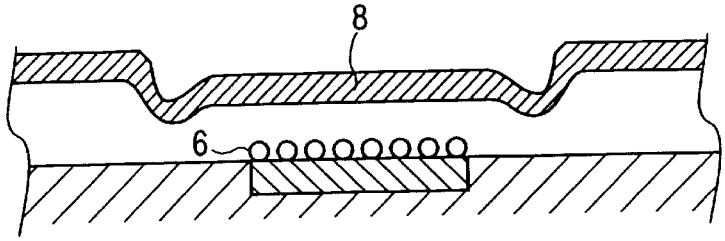

When thermal energy is given to the heat generating member 2 (consisting of a heat-generating resistance member of 40×105 μm in the present embodiment) in this state, the heat generating member 2 is rapidly heated whereby the surface thereof in contact with the second liquid in the bubble generating area heats the liquid and generates a bubble therein (FIG. 21B). A bubble 6 thus formed is based on a film boiling phenomenon as described in the U.S. Pat. No. 4,723,129 and is generated with an extremely high pressure over the entire area of the heat generating member. The generated pressure is transmitted as a pressure wave in the second liquid in the second liquid path 4 and acts on the movable separating membrane 5. As the height h2 from the bottom part 8*b* of the recessed portion 8 to the inflection part 8*c* thereof is selected equal to or larger than the height h1 from the heat generating member 2 to the bottom part 8*b* of the recessed portion 8, the pressure by bubble generation is transmitted to the movable separating membrane 5 before it can escape to the upstream and downstream sides of the second liquid path 4, so that the pressure can be efficiently transmitted to the movable separating membrane 5. The transmission of the pressure by bubble generation to the movable separating membrane causes deformation of the recessed portion 8 thereof, thereby initiating the discharge of the first liquid in the first liquid path 3. However the corner parts 8*a* formed at the fulcrums of the recessed portion 8 are not involved in such deformation.

Figure 21C:
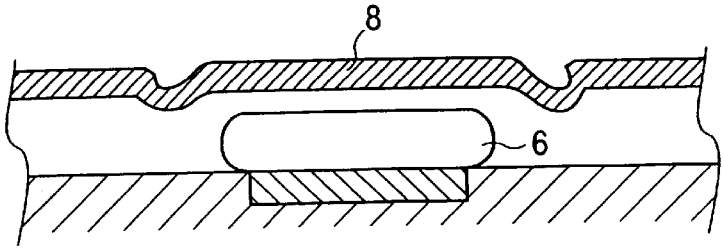

The bubble 6 generated on the entire surface of the heat generating member 2 rapidly grows to assume a film shape (FIG. 21C). The expansion of the bubble 6 with an extremely high pressure in the initial stage of generation causes a further deformation of the recessed portion 8 of the movable separating membrane 5, whereby the first liquid in the first liquid path 3 is further discharged from the discharge opening 1.

Figure 21D:
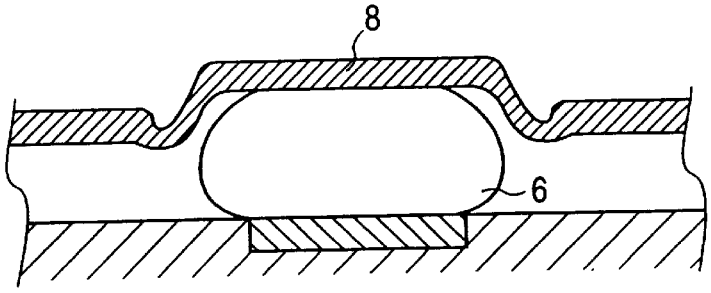

With the further growth of the bubble 6 thereafter, the deformation proceeds to such a level that the entire recessed portion 8, excluding the vicinity of the corner parts 8*a* of the membrane 5, enters the first liquid path 3 (FIG. 21D).

Figure 21E:
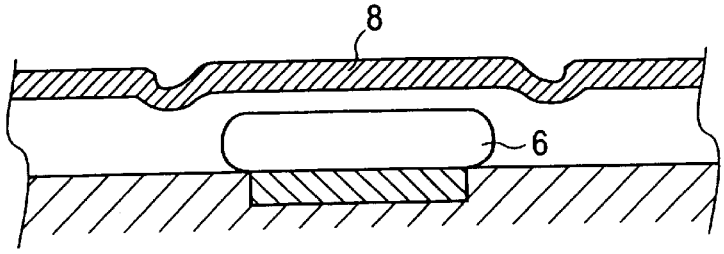

When the bubble 6 starts to contract thereafter, the recessed portion 8 of the movable separating membrane 5 starts to return to the position before deformation (FIG. 21E).

Figure 21F:
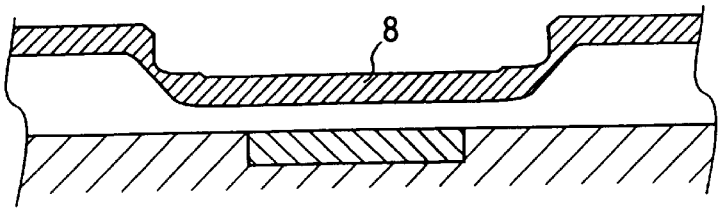

Subsequently, the recessed portion 8 of the movable separating membrane 5 promptly returns to the initial state shown in FIG. 21F by the self returning force exerted by the non-deformed corner parts 8*a,* whereby the liquid refilling in the first liquid path 3 is accelerated. Also, with the extinction of the bubble, the recessed portion 8 of the movable separating membrane 5 displaces into the second liquid path 4, thereby reducing the volume thereof and also reducing the refilling amount of the bubble generating liquid, whereby the refilling is completed promptly. Also, as the corner parts 8*a* of the recessed portion 8 have a function of suppressing the rebounding movement immediately after the displacement by bubble generation, the recessed portion 8 immediately returns to the initial state after displacement, thereby enabling high-speed drive.

FIGS. 22A to 22F are magnified cross-sectional views, along a line 22A to 22F–22A to 22F in FIG. 1A, of the recessed portion of the movable separating membrane in another embodiment, and show states respectively corresponding to those shown in FIGS. 1A to 1F.

Figure 22A:
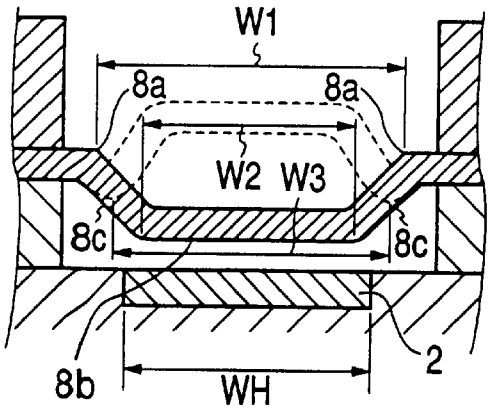
FIGS. 22A, 22B, 22C, 22D, 22E and 22F are magnified cross-sectional views, along a line 22A to 22F—22A to 22F in FIG. 1A, of the vicinity of the movable separating membrane in another embodiment of the present invention.
Figure 22B:
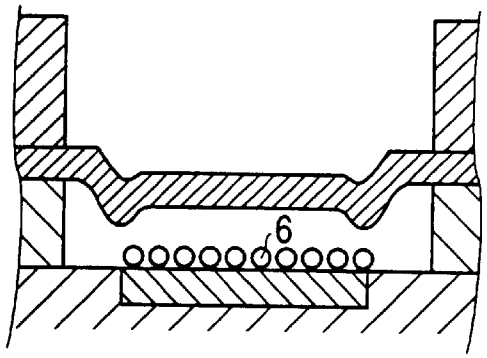
Figure 22C:
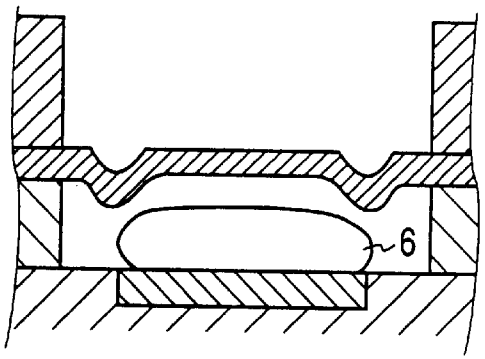
Figure 22D:
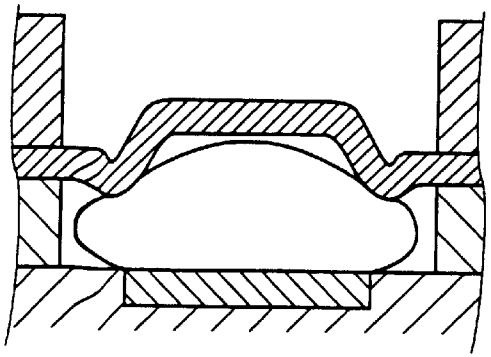
Figure 22E:
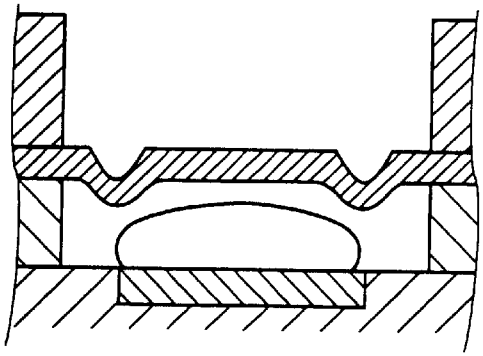
Figure 22F:
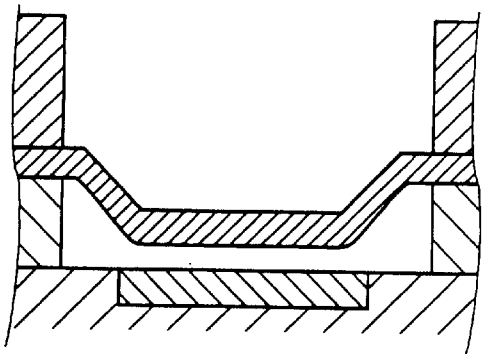

As shown in FIG. 22A, the distance between the corner parts is represented by W1, that between the inflection parts by W3, the width of the bottom part by W2 and that of the heat generating member by WH. If WH is larger than W1, the pressure by bubble generation cannot be efficiently transmitted to the movable separating membrane, so that an unnecessarily large pressure is required for deforming the recessed portion. On the other hand, if WH is smaller than W2, the pressure by bubble generation cannot be sufficiently transmitted to the entire bottom part of the recessed portion. Consequently, the recessed portion is desirable so designed as to satisfy a relation $W1 \geqq WH \geqq W2$ in order to improve the discharge efficiency.

The pressure by bubble generation can be more efficiently transmitted to the movable separating membrane by satisfying a relation $W1 \geqq W3 \geqq WH$, more preferably $W1 \geqq W3 \geqq WH \geqq W2$. The "inflection part" used in the present specification or in the appended drawings means a part, in the recessed portion of the movable separating membrane, showing the largest deformation at the maximum displacement.

Figure 23A:
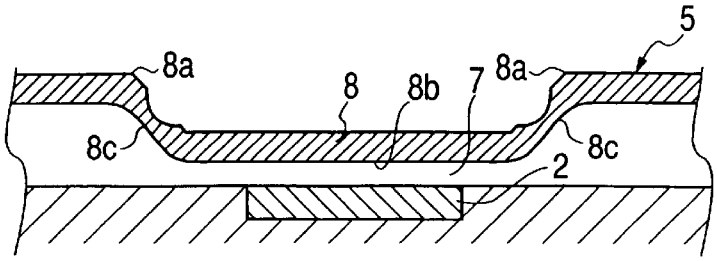
FIGS. 23A, 23B, 23C, 23D, 23E and 23F are magnified cross-sectional views of the vicinity of the movable separating membrane shown in another embodiment of the present invention shown in FIGS. 12A to 12F.

FIGS. 23A to 23F are magnified cross-sectional views of the vicinity of the recessed portion of the movable separating membrane in still another embodiment of the liquid discharging head of the present invention. In this embodiment, as shown in FIG. 23A, the recessed portion 8 of the movable separating membrane 5 has an inflection part 8*c* between the corner part 8*a* and the bottom part 8*b,* with a thickness smaller in the inflection part 8*c* than in the bottom part 8*b*. Other configurations are same as those in the foregoing embodiment.

In an initial state shown in FIG. 23A, the liquid in the first liquid path 3 is retracted to the vicinity of the discharge opening 1 by the capillary force. In the present embodiment, the discharge opening 1 is provided at the downstream position, in the liquid flow direction in the first liquid path 3, with respect to the projected area of the heat generating member 2 onto the first liquid path 3.

Figure 23B:
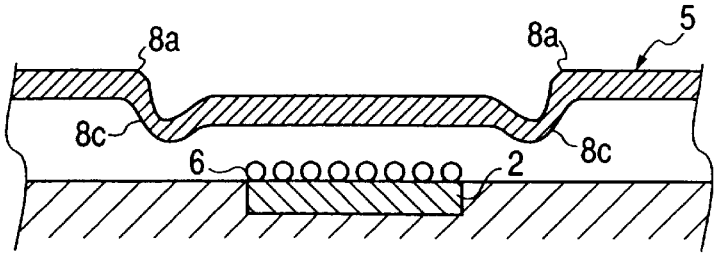

When thermal energy is given to the heat generating member 2 (consisting of a heat-generating resistance member of 40×105 μm in the present embodiment) in this state, the heat generating member 2 is rapidly heated whereby the surface thereof in contact with the second liquid in the bubble generating area heats the liquid and generates a bubble therein (FIG. 23B). A bubble 6 thus formed is based on a film boiling phenomenon as described in the U.S. Pat. No. 4,723,129 and is generated with an extremely high pressure over the entire area of the heat generating member. The generated pressure is transmitted as a pressure wave in the second liquid in the second liquid path 4 and acts on the movable separating membrane 5, whereby the recessed portion 8 of the movable separating membrane 5 deforms starting from the thinner inflection parts 8*c* to initiate the discharge of the first liquid in the first liquid path 3. However the corner parts 8*a* formed at the fulcrums of the recessed portion 8 are not involved in such deformation.

Figure 23C:
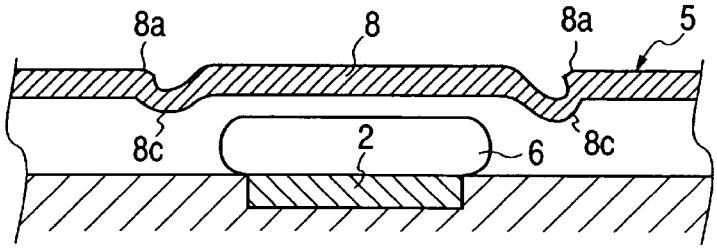

The bubble 6 generated on the entire surface of the heat generating member 2 rapidly grows to assume a film shape (FIG. 23C). The expansion of the bubble 6 with an extremely high pressure in the initial stage of generation causes a further deformation of the recessed portion 8 of the movable separating membrane 5, whereby the first liquid in the first liquid path 3 is further discharged from the discharge opening 1.

Figure 23D:
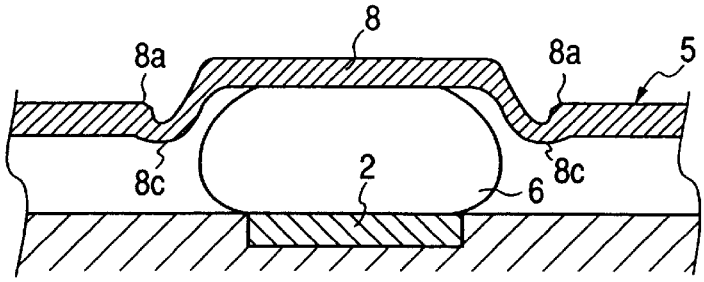

With the further growth of the bubble 6 thereafter, the deformation proceeds to such a level that the entire recessed portion 8, excluding the vicinity of the corner parts 8*a* of the membrane 5, enters the first liquid path 3 (FIG. 23D). Since the displacement of the recessed portion 8 from the initial state to the maximum displacement explained above is facilitated by the thinner inflection parts 8*c* of the recessed portion 8, the pressure by bubble generation can be efficiently transmitted toward the discharge opening, thereby improving the discharge efficiency.

Figure 23E:
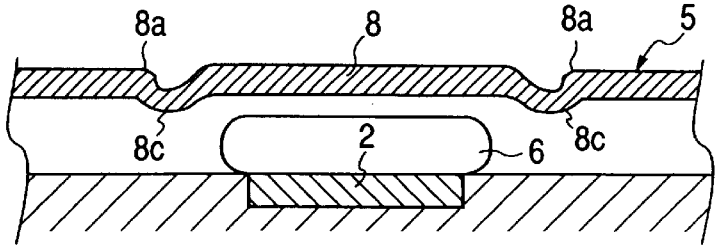

When the bubble 6 starts to contract thereafter, the recessed portion 8 of the movable separating membrane 5 starts to return to the position before deformation (FIG. 23E).

Figure 23F:
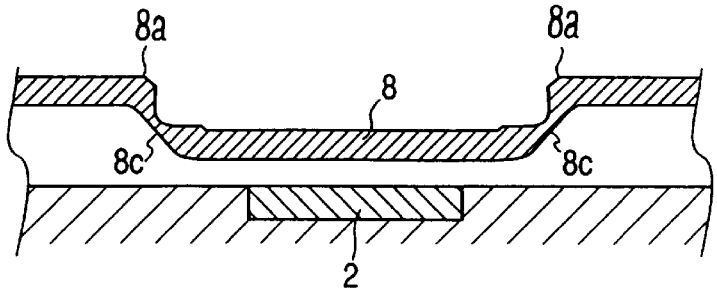

Subsequently, the recessed portion 8 of the movable separating membrane 5 promptly returns to the initial state shown in FIG. 23F by the self returning force exerted by the non-deformed corner parts 8*a,* whereby the liquid refilling in the first liquid path 3 is accelerated. Also, with the extinction of the bubble, the recessed portion 8 of the movable separating membrane 5 displaces into the second liquid path 4, thereby reducing the volume thereof and also reducing the refilling amount of the bubble generating liquid, whereby the refilling is completed promptly. Also, as the corner parts 8*a* of the recessed portion 8 have a function of suppressing the rebounding movement immediately after the displacement by bubble generation, the recessed portion 8 immediately returns to the initial state after displacement, thereby enabling high-speed drive.

Figure 24C:
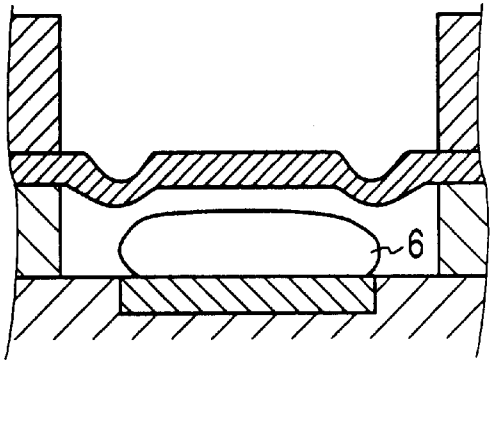
FIGS. 24A, 24B, 24C, 24D, 24E and 24F are magnified cross-sectional views of the vicinity of the movable separating membrane, seen from the side of the discharge opening, in another embodiment of the present invention shown in FIGS. 12A to 12F.
Figure 24B:
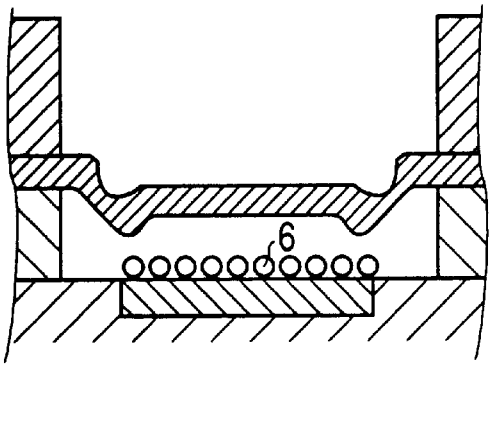
Figure 24A:
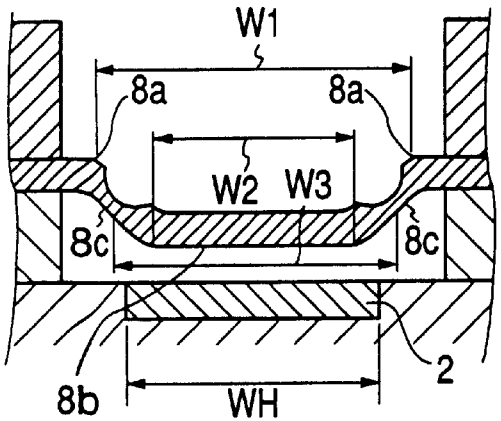
Figure 24F:
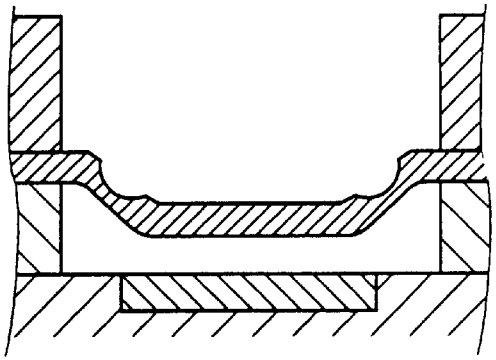
Figure 24E:
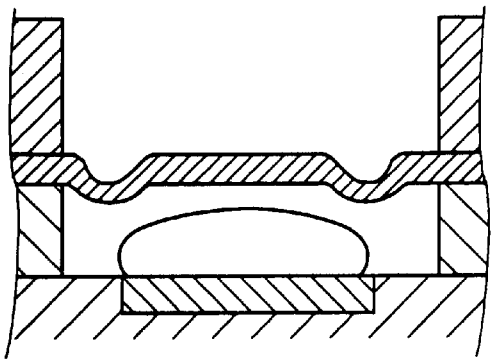
Figure 24D:
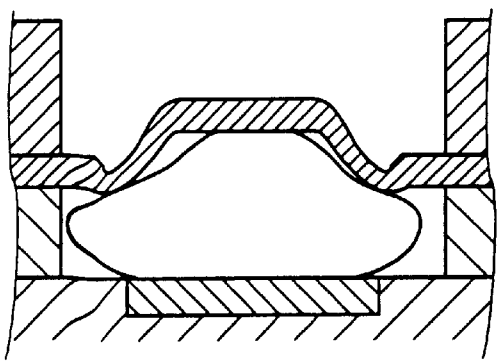

FIGS. 24A to 24F are magnified cross-sectional views, seen from the side of the discharge opening in FIGS. 12A to 12F, of the recessed portion of the movable separating membrane in another embodiment, and show states respectively corresponding to those shown in FIGS. 12A to 12F. As shown in FIG. 24A, the distance between the corner parts is represented by W1, that between the inflection parts by W3, the width of the bottom part by W2 and that of the heat generating member by WH. If WH is larger than W3, the pressure by bubble generation cannot be efficiently transmitted to the movable separating membrane, so that an unnecessarily large pressure is required for deforming the recessed portion. On the other hand, if WH is smaller than W2, the pressure by bubble generation cannot be sufficiently transmitted to the entire bottom part of the recessed portion. Consequently, the recessed portion is desirable so designed as to satisfy a relation W1≧WH≧W2 in order to improve the discharge efficiency, in addition to the aforementioned effect of forming thinner inflection parts. The pressure by bubble generation can be more efficiently transmitted to the movable separating membrane by satisfying a relation W1≧W3≧WH, more preferably W1≧W3≧WH≧W2.

Figure 25A:
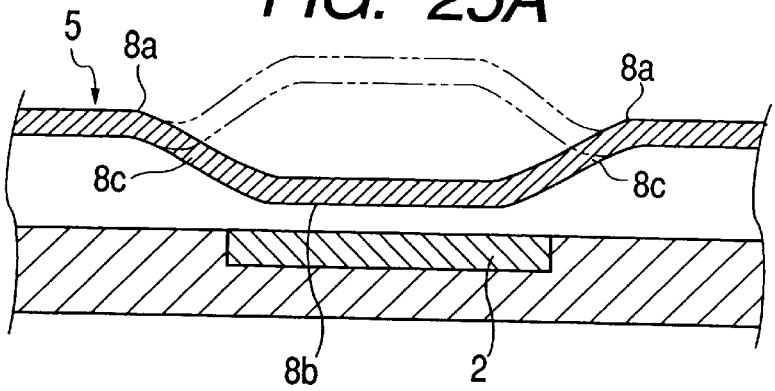
FIGS. 25A, 25B, 25C and 25D are views showing positional relationship between the heat generating member and the movable separating membrane in another embodiment of the present invention.
Figure 25B:
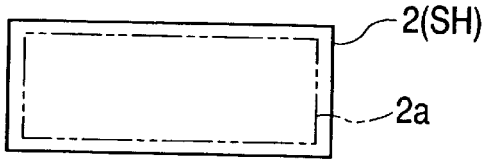
Figure 25C:
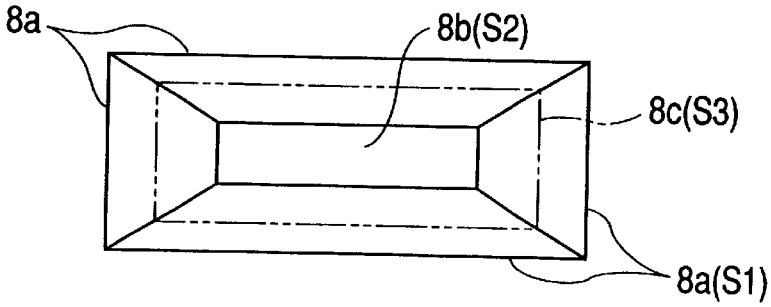
Figure 25D:
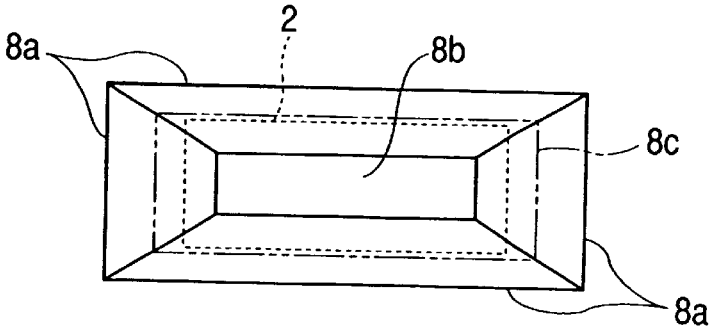

FIGS. 25A to 25D show the positional relationship between the heat generating member and the movable separating membrane in another embodiment, wherein FIG. 25A is a magnified cross-sectional view of the liquid discharging head along the liquid path thereof; FIG. 25B is a plan view of the heat generating member; FIG. 25C is a plan view of the movable separating membrane; and FIG. 25D is a plan view showing the heat generating member and the movable separating membrane in superposed state. As shown in FIG. 25A, the area defined by connecting the corner parts 8*a,* in the projection of the recessed portion toward the heat generating member, is taken as S1, the area of the bottom part 8*b* of the recessed portion is taken as S2, the area defined by connecting the inflection parts of the recessed portion is taken as S3, and the area of the heat generating member 2 is taken as SH. If SH is larger than S1, the pressure by bubble generation cannot be efficiently transmitted to the movable separating membrane, so that an unnecessarily large pressure is required for deforming the recessed portion. On the other hand, if SH is smaller than S2, the pressure by bubble generation cannot be sufficiently transmitted to the entire bottom part of the recessed portion. Consequently, the recessed portion is desirable so designed as to satisfy a relation S1≧SH≧S2 in order to improve the discharge efficiency. In the foregoing description, SH is the area of the entire heat generating member, but is more preferably an area showing effective film boiling (called effective bubble generating area) on the surface of the heat generating member 2.

The pressure by bubble generation can be more efficiently transmitted to the movable separating membrane by satisfying a relation S1≧S3≧SH, more preferably S1≧S3≧SH≧S2. The "inflection part" used in the present specification or in the appended drawings means a part, in the recessed portion of the movable separating membrane, showing the largest deformation at the maximum displacement.

Figure 26A:
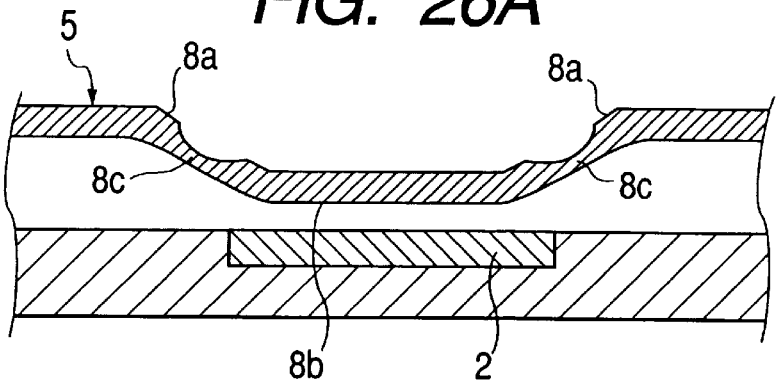
FIGS. 26A, 26B, 26C and 26D are views showing positional relationship between the heat generating member and the movable separating membrane in still another embodiment of the present invention.
Figure 26B:
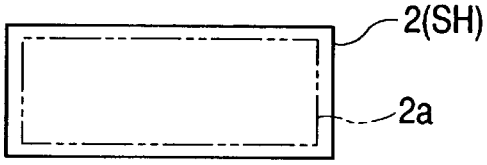
Figure 26C:
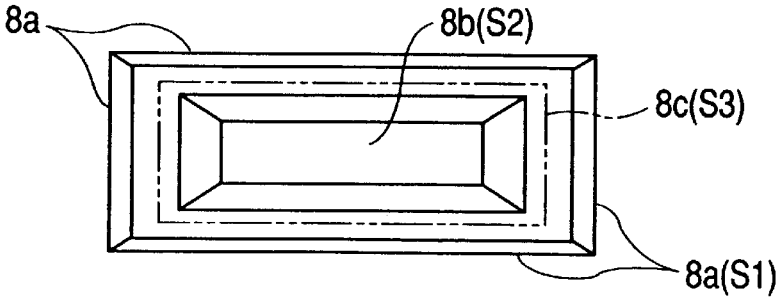
Figure 26D:
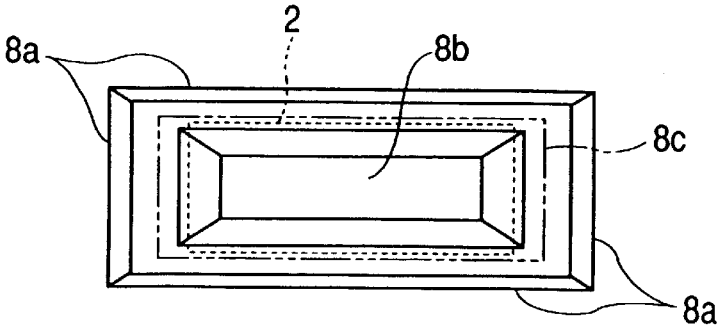

FIGS. 26A to 26D show the positional relationship between the heat generating member and the movable separating membrane in another embodiment, wherein FIG. 26A is a magnified cross-sectional view of the liquid discharging head along the liquid path thereof; FIG. 26B is a plan view of the heat generating member; FIG. 26C is a plan view of the movable separating membrane; and FIG. 26D is a plan view showing the heat generating member and the movable separating membrane in superposed state. As shown in FIG. 26A, the area defined by connecting the corner parts 8*a,* in the projection of the recessed portion toward the heat generating member, is taken as S1, the area of the bottom part 8*b* of the recessed portion is taken as S2, the area defined by connecting the inflection parts of the recessed portion is taken as S3, and the area of the heat generating member 2 is taken as SH. If SH is larger than S1, the pressure by bubble generation cannot be efficiently transmitted to the movable separating membrane, so that an unnecessarily large pressure is required for deforming the recessed portion. On the other hand, if SH is smaller than S2, the pressure by bubble generation cannot be sufficiently transmitted to the entire bottom part of the recessed portion. Consequently, the recessed portion is desirable so designed as to satisfy a relation S1≧SH≧S2 in order to improve the discharge efficiency, in addition to the aforementioned effect of forming thinner inflection parts. The pressure by bubble generation can be more efficiently transmitted to the movable separating membrane by satisfying a relation S1≧S3≧SH, more preferably S1≧S3≧SH≧S2. In the foregoing description, SH is the area of the entire heat generating member, but is more preferably an area showing effective film boiling (called effective bubble generating area) on the surface of the heat generating member 2.

FIGS. 27A to 27F are cross-sectional views showing another embodiment of the liquid discharging head of the present invention. The present embodiment is same in the basic working principle as the embodiment shown in FIGS. 1A to 3, but is different in that guide paths 9, 10 for enabling liquid flow are provided at the upstream and downstream sides of the bubble generating area 7.

Figure 27A:
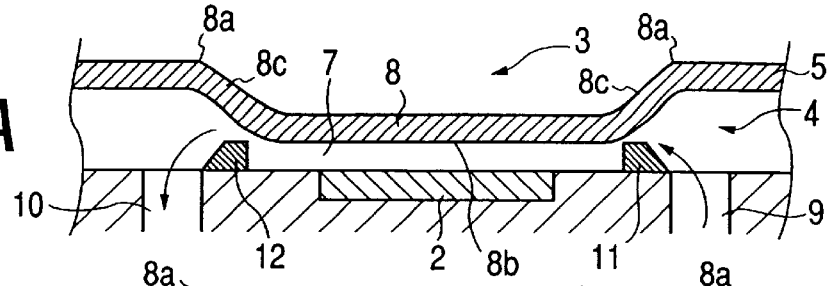
FIGS. 27A, 27B, 27C, 27D, 27E and 27F are cross-sectional views along the liquid path, showing another embodiment of the liquid discharging head of the present invention.

FIG. 27A shows a state of bringing the bubble generating liquid in the bubble generating area to an initial stable state by moving the bubble remaining in the liquid path and constituting a cause of instability and the extremely heated liquid by means of forced flow means to be explained later, prior to the bubble generating step by the heat generating member 2, in order to achieve stable bubble generation. The bubble generating liquid, supplied from the guide path 9, is discharged from the guide path 10 through the bubble generating area 7 so that the bubble generating area 7 can be brought to the initial stable state at any time. Therefore, stable discharge can be attained by such initializing operation after a prolonged pause or after heat accumulation or bubble generation by a high-duty drive.

Figure 27B:
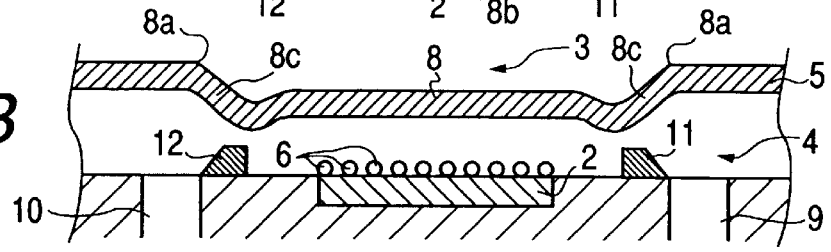

FIGS. 27B to 27F show steps of generation and extinction of the bubble 6 in the bubble generating area 7 by the heat generating member 2. In these states, when energy is given to the heat generating member 2 it heats the second liquid (bubble generating liquid) to generate a bubble therein (FIG. 27B). The pressure generated by bubble generation is transmitted as a pressure wave in the second liquid (bubble generating liquid) in the second liquid path 4 and acts on the movable separating membrane 5, whereby the recessed portion 8 of the movable separating membrane 5 deforms to initiate the discharge of the first liquid (discharge liquid) in the first liquid path 3.

Figure 27C:
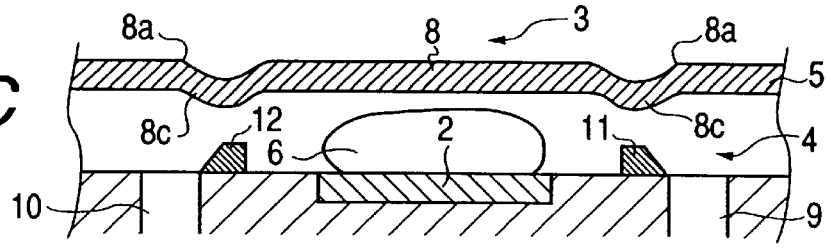
Figure 27D:
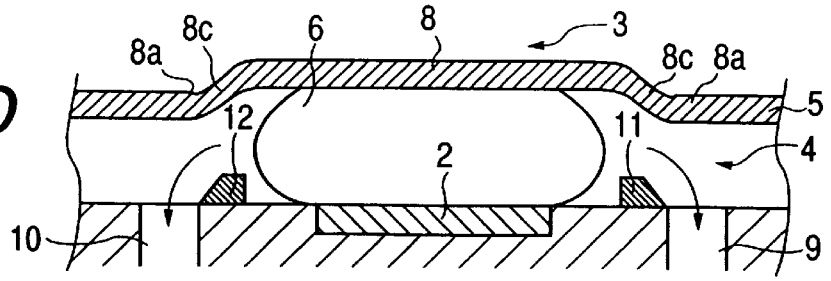

The bubble 6 rapidly grows to assume a film shape (FIG. 27C). The expansion of the bubble 6 with an extremely high pressure in the initial state of generation causes a further deformation of the recessed portion 8 of the movable separating membrane 5, whereby the first liquid (discharge liquid) in the first liquid path 3 is further discharged from the discharge opening 1. With the further growth of the bubble 6 thereafter, the deformation process to such a level that the entire recessed portion 8, excluding the vicinity of the corner parts 8*a* of the membrane 5, enters the first liquid path 3 (FIG. 27D).

Figure 27E:
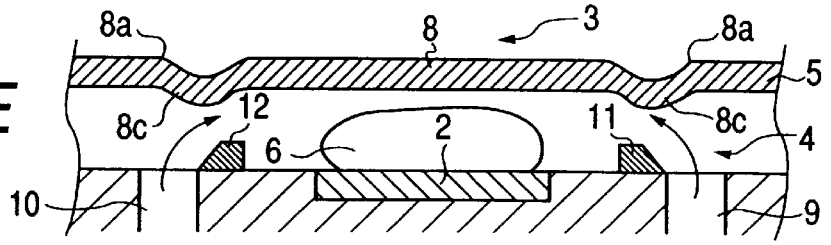
Figure 27F:
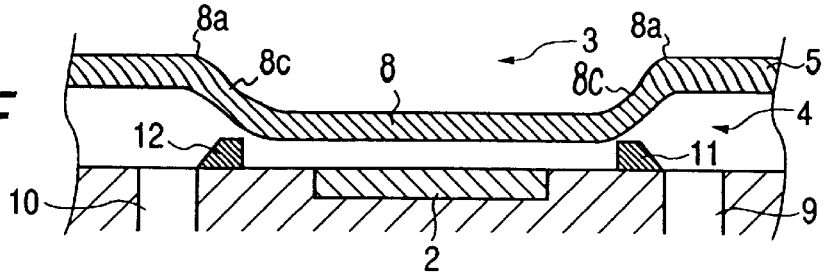

When the bubble 6 starts to contract thereafter, the recessed portion 8 of the movable separating membrane 5 starts to return to the position before deformation (FIG. 27E). Subsequently, the recessed portion 8 of the movable separating membrane 5 promptly returns to the initial state shown in FIG. 27F by the self returning force exerted by the non-deformed corner parts 8*a,* whereby the liquid refilling in the first liquid path 3 is accelerated. Also, with the extinction of the bubble, the recessed portion 8 of the movable separating membrane 5 displaces into the second liquid path 4, thereby reducing the volume thereof and also reducing the refilling amount of the bubble generating liquid, whereby the refilling is completed promptly.

The present embodiment can stabilize the discharge amount since the movable separating membrane 5 having the recessed portion 8 is substantially free from elongation. It is particularly important, however, that the displacement volume of the movable separating membrane 5 is small with respect to the maximum volume of the bubble 6, so that the discharge amount is stabilized with respect to the variation in the volume of the bubble. In the state shown in FIG. 27D, if the displacement volume of the movable separating membrane 5 is extremely different from the maximum volume of the bubble 6, the stress on the membrane 5 may become very high, detrimentally affecting the service life thereof. In the present embodiment, however, the guide paths 9, 10 are provided at the upstream and downstream sides of the bubble generating area 7 and are adapted to discharge the second liquid (bubble generating liquid) so as to absorb the excessive volume of the bubble 6, thereby realizing high stability and high durability. Also the durability problem of the membrane, encountered in case the membrane displacement cannot follow the abrupt volumic change at the contraction of the bubble can be solved by the pressure adjusting and relaxing function of these guide paths, whereby high stability and high durability can be realized. In particular, the present embodiment realizes highly stable discharge, because the guide paths are balanced at the upstream and downstream sides to enable well balanced displacement of the movable separating membrane 5.

Also in the present embodiment, liquid path resistances 11, 12 are provided at the junctions with the guide paths 9, 10 in order to prevent unnecessary dissipation of the pressure of the bubble generating area 7 into the guide paths 9, 10.

Figure 28A:
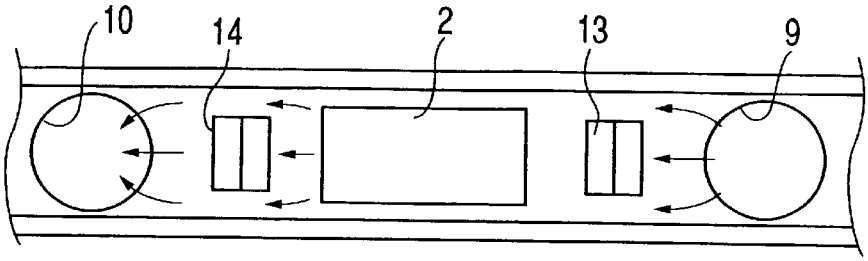
FIGS. 28A, 28B, 28C and 28D are plan views and a cross-sectional view showing an example of the second liquid path in another embodiment of the liquid discharging head of the present invention.
Figure 28B:
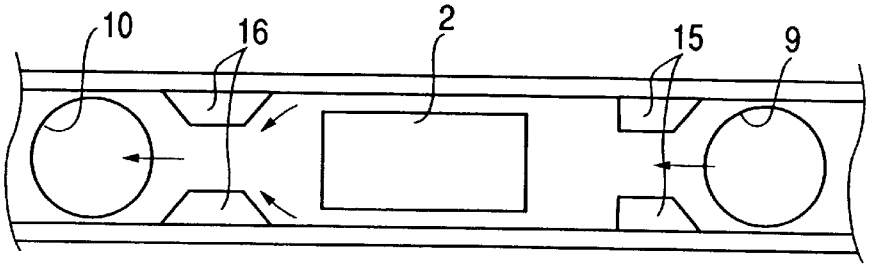
Figure 28C:
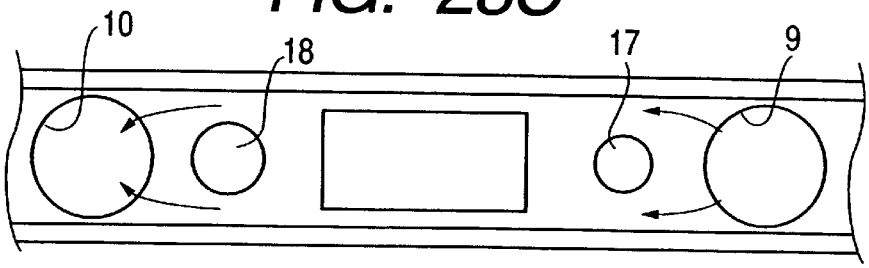
Figure 28D:
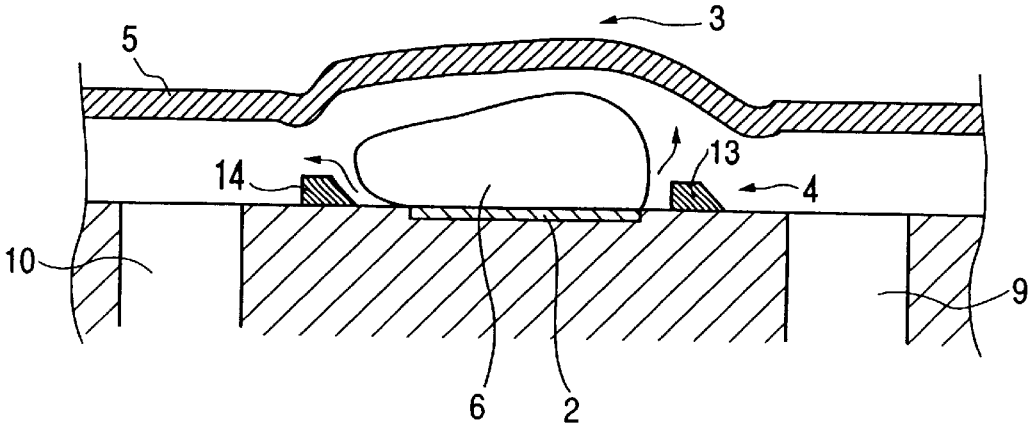

FIGS. 28A to 28D show still another embodiment, in which the liquid path resistances, provided as in the foregoing embodiment, are made mutually different at the upstream and downstream sides. FIG. 28D is a cross-sectional view showing a state of bubble generation in the configuration shown in FIG. 28A.

In FIG. 28A, the liquid path resistances 13, 14 are so formed as to facilitate the liquid flow in the downstream direction but to hinder it in the upstream direction. Consequently, at the generation of the bubble 6 by the heat generating member 2, the bubble 6 grows at the upstream side in such a direction as to push up the movable separating membrane 5 but at the downstream side toward the downstream guide path 10, whereby the movable separating membrane 5 shows a larger displacement at the upstream side (FIG. 28D). As a result, there is generated a flow of the discharge liquid (first liquid) from the upstream side to the downstream side, thereby improving the refilling efficiency for the discharge (first) liquid. The configurations shown in FIGS. 28B and 28C can also improve the discharge characteristics by differentiating the balance of the liquid path resistances 15, 16, 17, 18.

Figure 29:
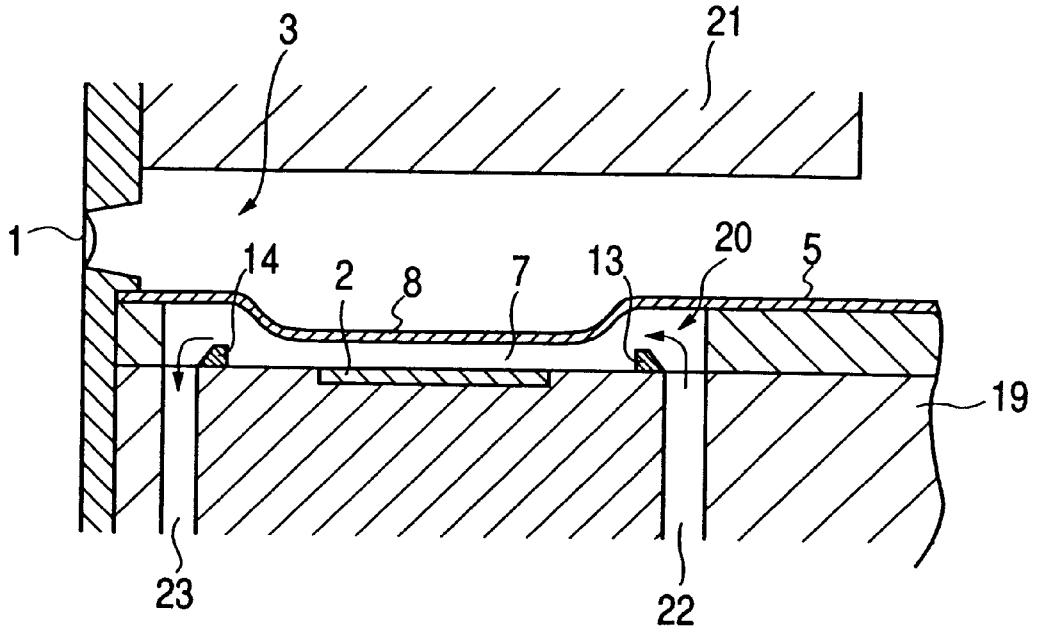
FIG. 29 is a cross-sectional view showing the principal parts of another embodiment of the liquid discharging head of the present invention.
Figure 30:
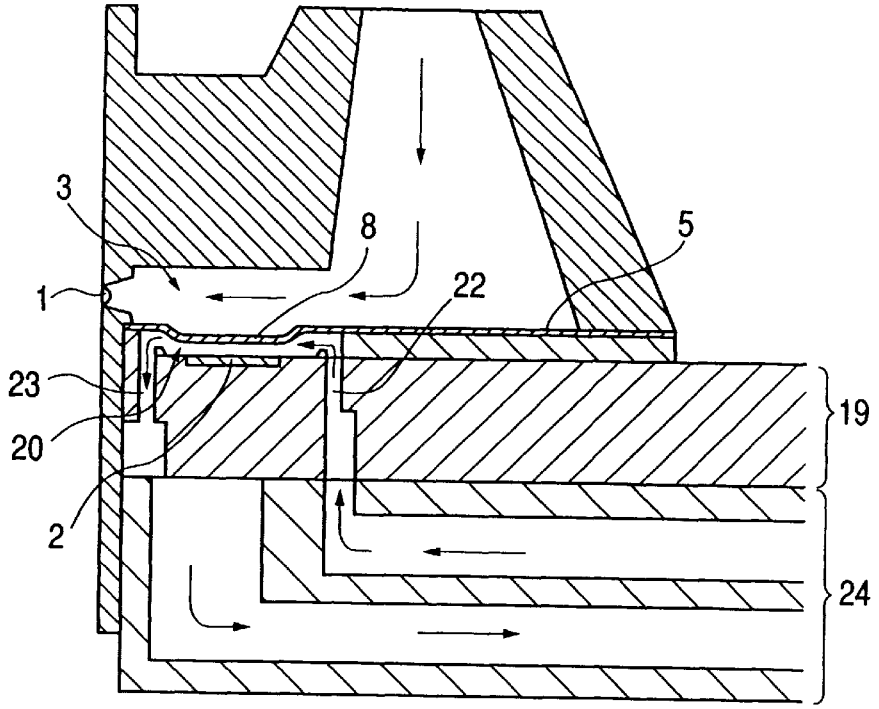
FIG. 30 is a cross-sectional view showing the entire structure of the liquid discharging head shown in FIG. 29.

FIGS. 29 and 30 are longitudinal cross-sectional views of other embodiments of the liquid discharging head of the present invention. As shown in these drawings, there are provided a second liquid path 20 including holes provided in the element substrate 19, a movable separating membrane 5 constituting a partition wall, and a grooved member 21 provided with a groove constituting the first liquid path 3. The holes in the substrate 19 can be formed for example by sand blasting or etching. The holes in the substrate, formed at the upstream nd downstream sides of the bubble generating area 7, are used as guide paths 22, 23 for enabling the flow of the bubble generating liquid.

FIGS. 29 and 30 are longitudinal cross-sectional views showing an embodiment of the liquid discharging head utilizing holes in the element substrate. In this embodiment, the guide paths 22, 23 are connected to a second liquid path 20, provided in a base plate 24 on which the element substrate 19 is adhered. The bubble generating liquid can be circulated or made to flow by forced flow means, such as a pump (not shown), connected to the second liquid path 20. On the other hand, the first liquid is supplied by the first liquid path 3, positioned opposite to the guide paths 22, 23 and separated by the movable separating membrane 5. Consequently the entire configuration is simple and highly reliable in preventing the mutual mixing of the liquids. Also the pressure from the liquid paths 22, 23 can be accommodated since the cross section of the liquid paths can be selected sufficiently large.

Figure 31:
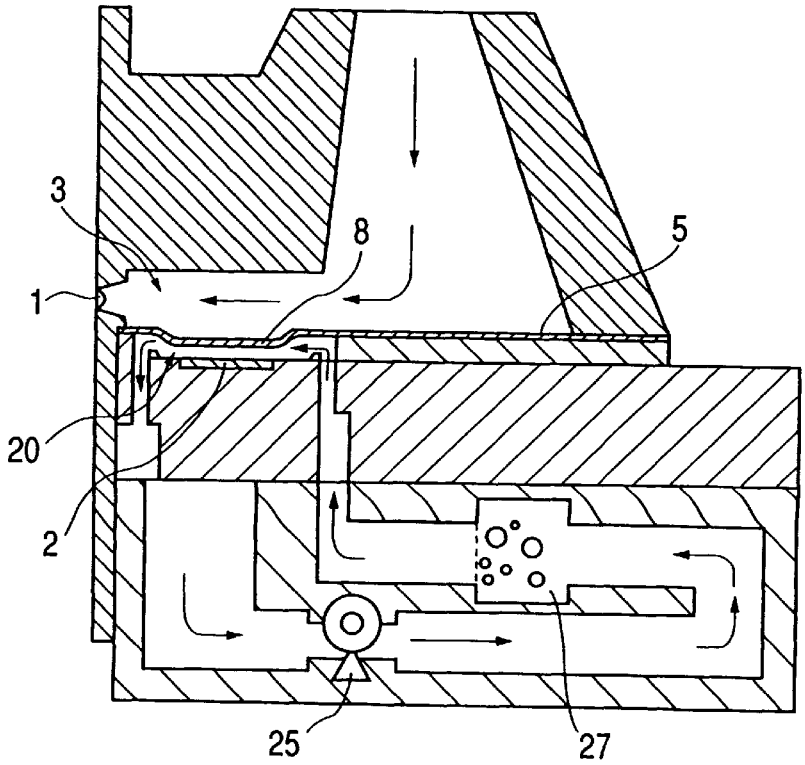
FIG. 31 is a cross-sectional view showing another embodiment of the liquid discharging head of the present invention.

FIG. 31 is a schematic lateral cross-sectional view showing another embodiment of the liquid discharging head of the present invention. In this embodiment, the second liquid path in the head is constructed as a circulating structure including a pump 25 serving as forced flow means. In this embodiment, a bubble reservoir 27 is provided at the upstream side of the second liquid path 26 for eliminating a bubble etc. eventually contained in the second liquid (bubble generating liquid), thereby stabilizing the bubble generation and the liquid discharge.

Figure 32A:
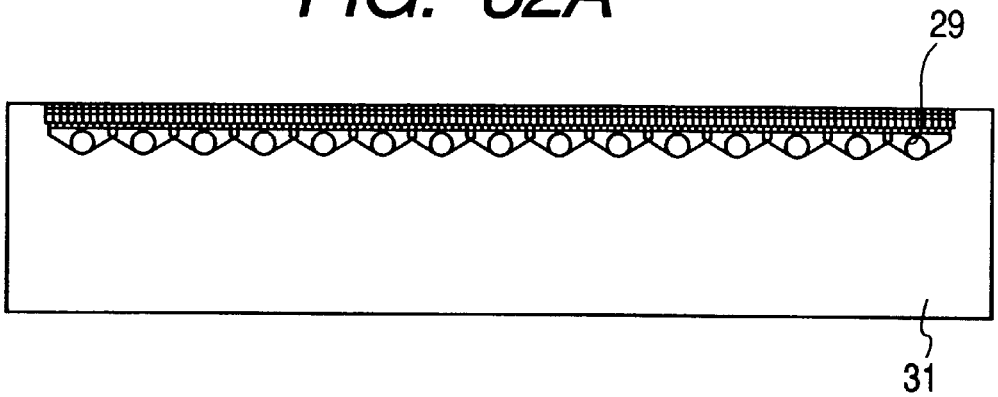
FIG. 32A is a plan view of an element board in another embodiment of the liquid discharging head of the present invention.
Figure 32B:
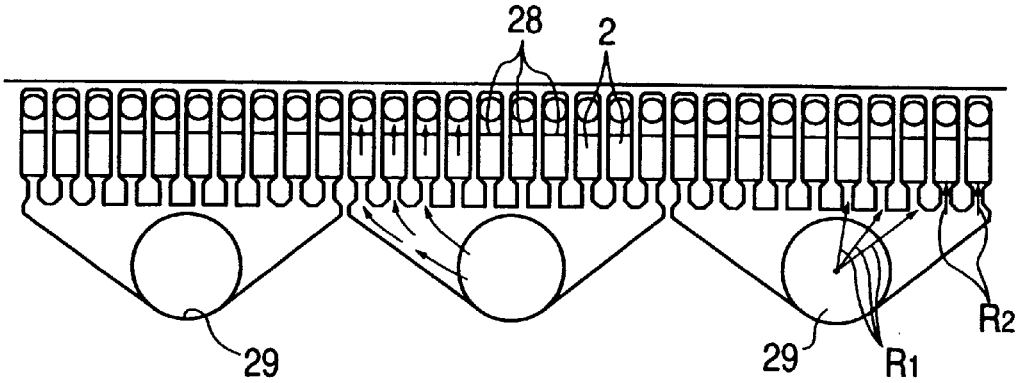
FIG. 32B is a partial magnified view of the board shown in FIG. 32A.
Figure 32C:
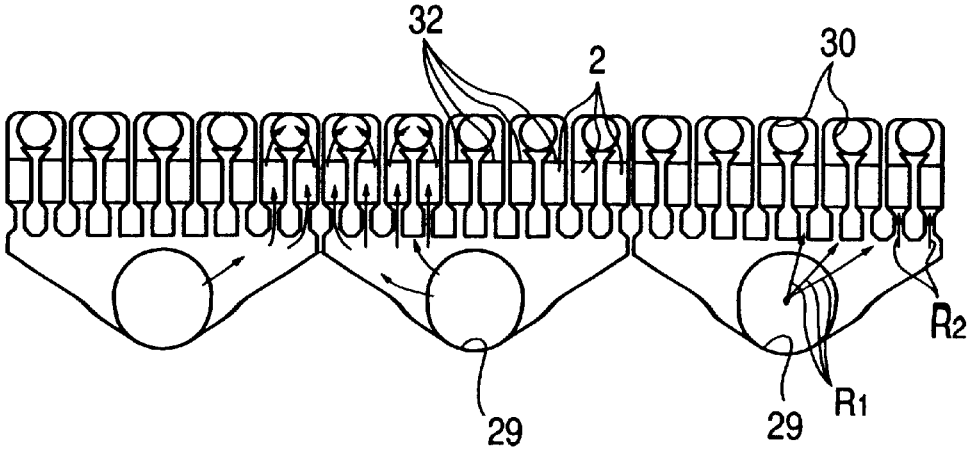
FIG. 32C is a magnified partial plan view of still another embodiment.

FIG. 32A is a schematic view showing another embodiment of the liquid discharging head of the present invention, and FIG. 32B is a magnified view thereof. In this embodiment, second liquid paths 28 provided on an element substrate 31 are divided in the unit of 10 nozzles, whereby the second liquid (bubble generating liquid) can be made to flow with a uniform flow rate at the center and at the ends of the head. In order that the liquid in the second liquid paths 28 has a uniform flow rate over the nozzles, the liquid path resistance R1 from a supply inlet (guide path 29) to the entrance of each nozzle and the liquid path resistance R2 at the entrance are so selected that R1+R2 is constant in each nozzle. FIG. 32C shows an embodiment in which an exit (guide path 30) is provided for every two heat generating members 2 and two second liquid paths 32. There is thus realized a head showing uniform liquid path resistance to each nozzle and little fluctuation in the characteristics between the nozzles.

Figure 33:
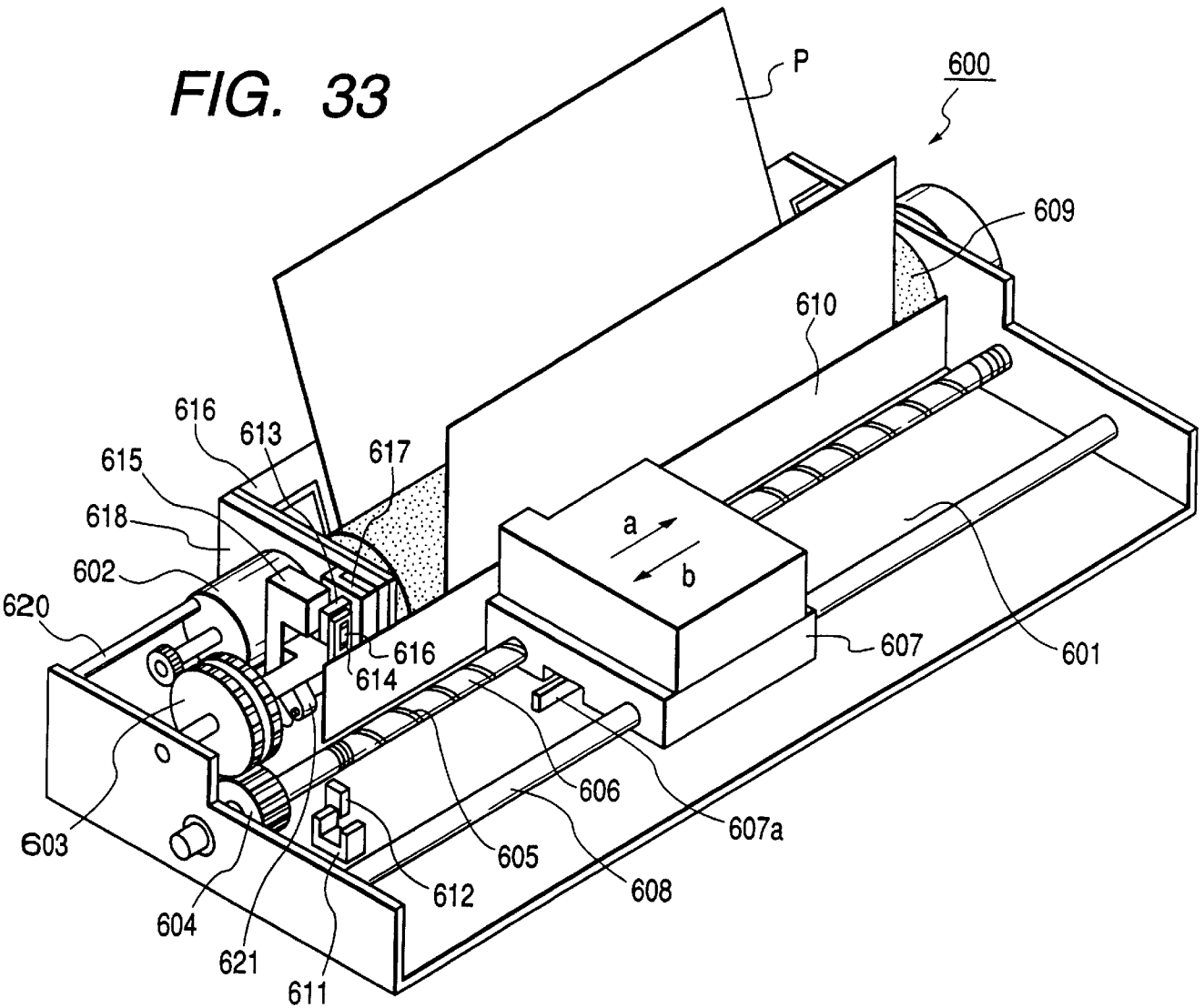
FIG. 33 is a schematic perspective view showing the principal parts of an ink jet recording apparatus, constituting the liquid discharging apparatus in which the liquid discharging head of the present invention is mounted.

FIG. 33 is a schematic perspective view showing the principal parts of an ink jet recording apparatus, constituting the liquid discharging apparatus in which the liquid discharging head is mounted.

Referring to FIG. 33, there is shown an ink jet head cartridge 601 in which the liquid discharging head of the aforementioned configuration and an ink tank are integrated or the ink tank is made detachable. The head cartridge 601 is mounted on a carriage 607, engaging with a spiral groove 606 of a lead screw 605, which is rotated through transmission gears 603, 604 by the forward or reverse rotation of a driving motor 602, and the cartridge is reciprocated, together with the carriage 607 in directions a and b, along a guide member 608 and by the rotation of the motor 602. A printing sheet P, fed by an unrepresented feeding device on a platen roller 609, is pressed thereto by a pressure plate 610 along the moving direction of the carriage.

In the vicinity of an end of the lead screw 605, there are provided photocouplers 611, 612 constituting home position detection means, which detects the presence of a lever 607*a* of the carriage 607 for switching, for example, the driving direction of the motor 602.

There are also shown a support member 613 for supporting a cap member 614 for covering the front face, having the discharge openings, of the aforementioned liquid discharge head; ink suction means 615 for sucking ink, which remains in the cap member 614 by idle discharge from the head 601 and for executing suction recovery of the head 601 through an aperture in the cap member; a cleaning blade 617 and a moving member 618 for moving the blade 617 in a direction perpendicular to the moving direction of the carrier 607, wherein the blade 617 and the moving member 618 are supported by a main body support member 619. The blade 617 is not limited to the above-described configuration but may assume other known forms. There is also shown a lever 620 for starting the suction operation at the suction recovery. It is moved by the movement of a cam 621 engaging with the carriage 607, whereby the driving force from the motor 602 is controlled by known transmission means such as a clutch.

A control unit for supplying signals to the heat generating members 202 in the head 601 and for controlling various mechanisms is provided in the main body of the apparatus and is therefore not illustrated. The ink jet recording apparatus 600 of the above-described configuration executes recording on the printing sheet P, fed by the unrepresented feeding device on the platen 609, by the reciprocating motion of the head 601 over the entire width of the sheet P.

Figure 34:
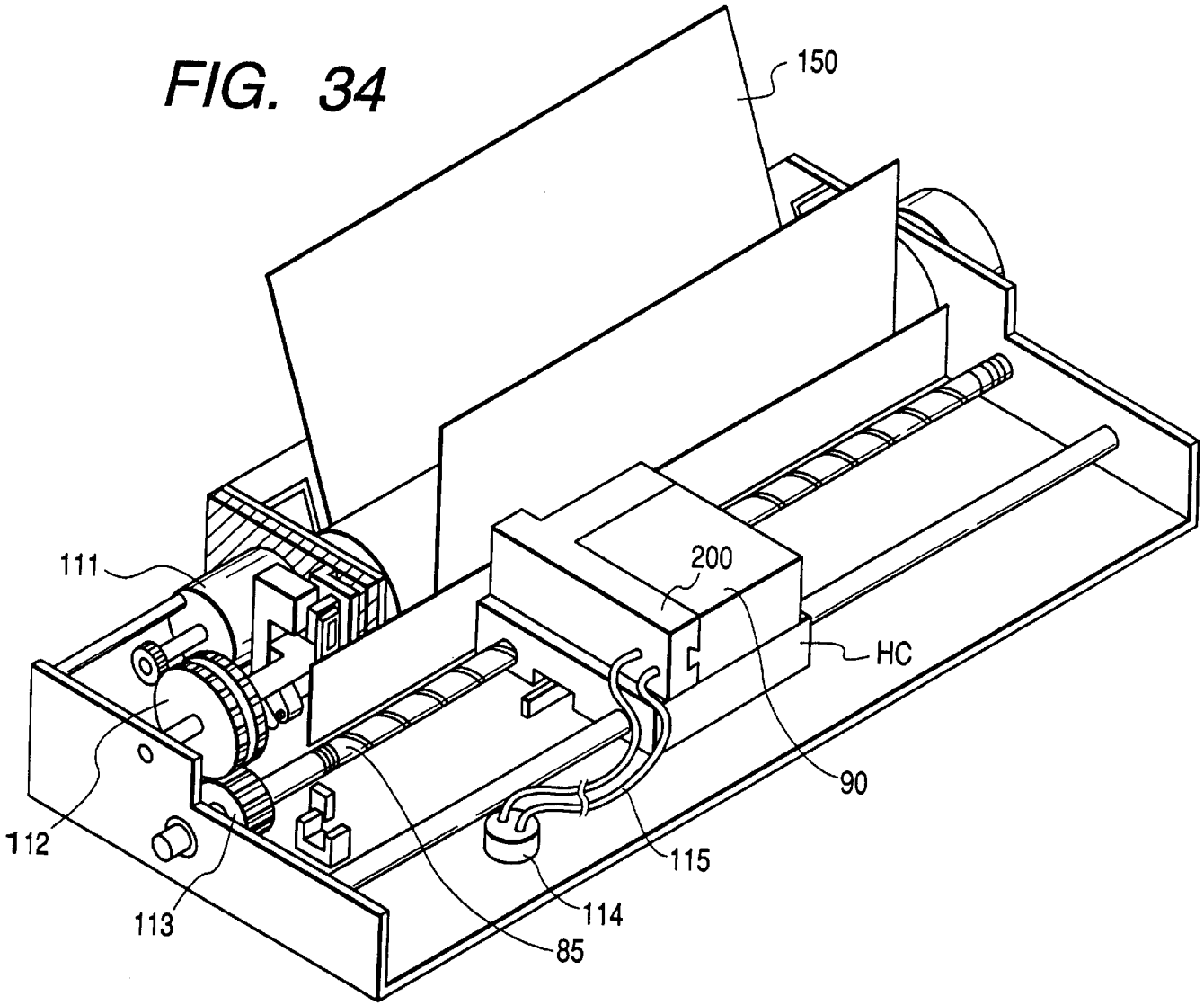
FIG. 34 is a schematic perspective view showing the principal parts of the liquid discharging apparatus constituting another embodiment of the present invention.

FIG. 34 is a schematic perspective view showing the principal parts of another embodiment of the liquid discharging apparatus in which the liquid discharging head is mounted. This embodiment will be explained by an ink discharging recording apparatus, utilizing ink as the discharge liquid. A carriage HC of the apparatus supports a head cartridge in which a liquid tank 90 containing ink and a liquid discharging head unit 200 are detachably mounted, and executes reciprocating motion in the transversal direction of a recording medium 150 such as paper transported by recording medium transporting means.

Unrepresented signal supply means supplies the liquid discharging means in the carriage with drive signals, in response to which the liquid discharging head discharges the recording liquid to the recording medium.

The liquid discharging apparatus of this embodiment is further provided with a motor 111 for driving the recording medium transport means and the carriage, gears 112, 113 for transmitting the power from the motor to the carriage, a carriage shaft 85 etc. There is also provided a circulating pump 114 for circulating the liquid by sending the liquid to the head and receiving the liquid therefrom, and is connected, through tubes 115, to the aforementioned guide paths connected to the liquid path of the head. Such recording apparatus and the liquid discharging process executed therein provided satisfactory images by liquid discharge onto various recording media.

What is claimed is:

1. A liquid discharging head comprising:

a discharge liquid path communicating with a discharge opening for discharging a discharge liquid and adapted to flow said discharge liquid;

a bubble generating liquid path including a bubble generating area for bubble generation and adapted to flow a bubble generating liquid; and a movable separating membrane adapted for mutually and substantially separating said discharge liquid path and said bubble generating liquid path and having a recess, in a position corresponding to said bubble generating area, deviated so as to narrow said bubble generating liquid path;

wherein said recess has substantially non-displacing corner portions and is adapted to displace, excluding said corner portions, by a bubble generated in said bubble generating area.

2. A liquid discharging head according to claim 1, wherein the displacing portion of said recess is a central area of said recess, surrounded by said corner portions.

3. A liquid discharging head comprising:

a discharge liquid path communicating with a discharge opening for discharging a discharge liquid and adapted to flow said discharge liquid;

a bubble generating liquid path including a bubble generating area for bubble generation and adapted to flow a bubble generating liquid; and a movable separating membrane adapted for mutually and substantially separating said discharge liquid path and said bubble generating liquid path and having a recess, in a position corresponding to said bubble generating area, deviated so as to narrow said bubble generating liquid path;

wherein the volume V1 of said recess in a still state and the volume V2 of said recess at the maximum displacement satisfy a relation:

$$V2<V1.$$

4. A liquid discharging head according to claim 3, wherein said recess has substantially non-displacing corner portions and is adapted to displace, excluding said corner portions, by a bubble generated in said bubble generating area.

5. A liquid discharging head according to claim 1 or 3, wherein said bubble generating liquid path includes, corresponding to said bubble generating area, a heat generating member for generating heat for generating a bubble.

6. A liquid discharging head according to claim 5, wherein the bubble generated in said bubble generating area is caused by film boiling phenomenon.

7. A liquid discharging head according to claim 1 or 3, wherein said recess has inflection portions constituting fulcrums of displacement, and said movable separating membrane is made thinner at said inflection portions.

8. A liquid discharging head according to claim 1 or 3, wherein said recess has inflection portions constituting fulcrums of displacement, and the height h1 from said heat generating member to the bottom portion of said recess in the still state thereof and the height h2 from the bottom portion of said recess to said inflection portions in the still state of said recess satisfy a relation:

$$h2 \geqq h1.$$

9. A liquid discharging head according to claim 8, wherein h1 is within a range from 5 to 10 $\mu$m.

10. A liquid discharging head according to claim 1 or 3, wherein said recess has inflection portions constituting fulcrums of displacement, and the distance W1 between the corner portions of said recess seen from the side of said discharge opening, width W2 of the bottom portion of said recess and width WH of said heat generating member satisfy a relation:

$$W1 \geqq WH \geqq W2.$$

11. A liquid discharging head according to claim 1 or 3, wherein said recess has inflection portions constituting fulcrums of displacement, and the distance W1 between the corner portions of said recess seen from the side of said discharge opening, distance W3 of the inflection portions of said recess and width WH of said heat generating member satisfy a relation:

$$W1 \geqq W3 \geqq WH.$$

12. A liquid discharging head according to claim 11, wherein the width W2 of the bottom portion of said recess and width WH of said heat generating member satisfy a relation:

$$WH \geqq W2.$$

13. A liquid discharging head according to claim 1 or 3, wherein said recess has inflection portions constituting fulcrums of displacement, and, in the projected areas toward said heat generating member, the area S1 formed by connecting the corner portions of said recess, area S2 of the bottom portion of said recess and area SH of said heat generating member satisfy a relation:

$$S1 \geqq SH \geqq S2.$$

14. A liquid discharging head according to claim 13, wherein SH is the area of an effective bubble generating area of said heat generating member.

15. A liquid discharging head according to claim 1 or 3, wherein said recess has inflection portions constituting fulcrums of displacement, and, in the projected areas toward said heat generating member, the area S1 formed by connecting the corner portions of said recess, area S3 formed by connecting the inflection portions of said recess area SH of said heat generating member satisfy a relation:

$$S1 \geqq S3 \geqq SH.$$

16. A liquid discharging head according to claim 15, wherein the area S2 of the bottom portion of said recess and area SH of said heat generating member satisfy a relation:

$$SH \geqq S2.$$

17. A liquid discharging head according to claim 15, wherein SH is the area of an effective bubble generating area of said heat generating member.

18. A liquid discharging head according to claim 1 or 3, wherein the bubble generating liquid flows in said bubble generating liquid path and in a guide path provided in a substrate and communicating with said bubble generating liquid path .

19. A liquid discharging head according to claim 18, wherein the flow of the bubble generating liquid in said bubble generating liquid path and in said guide path is executed by forced flow means.

20. A liquid discharging head according to claim 18, wherein the bubble generating liquid paths are divided by said guide paths into plural blocks, whereby the bubble generating liquid flows uniformly on said heat generating members.

21. A liquid discharging head according to claim 18, wherein said bubble generating liquid path includes a bubble reservoir in a part thereof.

22. A liquid discharging head according to claim 1 or 3, wherein the discharge liquid and the bubble generating liquid are mutually same.

23. A liquid discharging head according to claim 1 or 3, wherein the discharge liquid and the bubble generating liquid are mutually different.

24. A liquid discharging head according to claim 23, wherein the bubble generating liquid is superior to the discharge liquid in at least one of the low viscosity, bubble generating ability and thermal stability.

25. A liquid discharging apparatus comprising:

a liquid discharging head including a discharge liquid path communicating with a discharge opening for discharging a discharge liquid and adapted to flow said discharge liquid; a bubble generating liquid path including a bubble generating area for bubble generation and adapted to flow a bubble generating liquid; and a movable separating membrane adapted for mutually and substantially separating said discharge liquid path and said bubble generating liquid path and having a recess, in a position corresponding to said bubble generating area, deviated so as to narrow said bubble generating liquid path; wherein said recess has substantially non-displacing corner portions and is adapted to displace, excluding said corner portions, by a bubble generated in said bubble generating area; and transport means for transporting a recording medium for forming a record by receiving the discharge liquid from said liquid discharging head.

26. A liquid discharging apparatus comprising:

a liquid discharging head including a discharge liquid path communicating with a discharge opening for discharging a discharge liquid and adapted to flow said discharge liquid; a bubble generating liquid path including a bubble generating area for bubble generation and adapted to flow a bubble generating liquid; and a movable separating membrane adapted for mutually and substantially separating said discharge liquid path and said bubble generating liquid path and having a recess, in a position corresponding to said bubble generating area, deviated so as to narrow said bubble generating liquid path; wherein the volume V1 of said recess in a still state and the volume V2 of said recess at the maximum displacement satisfy a relation $V2<V1$; and transport means for transporting a recording medium for forming a record by receiving the discharge liquid discharged from said liquid discharging head.

* * * * *